US011629831B2

(12) United States Patent
Qiu et al.

(10) Patent No.: US 11,629,831 B2
(45) Date of Patent: Apr. 18, 2023

(54) VEHICLE LAMP ILLUMINATION MODULE, VEHICLE LAMP AND VEHICLE

(71) Applicant: HASCO VISION TECHNOLOGY CO., LTD., Shanghai (CN)

(72) Inventors: Zhiping Qiu, Shanghai (CN); He Zhu, Shanghai (CN); Dapan Zhang, Shanghai (CN); Cong Li, Shanghai (CN); Xiaofen Sun, Shanghai (CN); Wenhui Sang, Shanghai (CN); Hui Li, Shanghai (CN); Rui Nie, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/422,704

(22) PCT Filed: Jan. 22, 2020

(86) PCT No.: PCT/CN2020/073848

§ 371 (c)(1),
(2) Date: Jul. 13, 2021

(87) PCT Pub. No.: WO2020/156455

PCT Pub. Date: Aug. 6, 2020

(65) Prior Publication Data

US 2022/0065416 A1 Mar. 3, 2022

(30) Foreign Application Priority Data

Jan. 29, 2019 (CN) ..... 201910083832.7
Mar. 5, 2019 (CN) ..... 201910164892.1
(Continued)

(51) Int. Cl.
*F21S 41/24* (2018.01)
*F21S 41/143* (2018.01)
(Continued)

(52) U.S. Cl.
CPC ..... *F21S 41/143* (2018.01); *F21S 41/147* (2018.01); *F21S 41/151* (2018.01); *F21S 41/24* (2018.01);
(Continued)

(58) Field of Classification Search
CPC ..... F21S 41/24; F21S 41/25; F21S 41/143; F21S 41/147; F21S 41/151;
(Continued)

(56) References Cited

U.S. PATENT DOCUMENTS

2009/0021942 A1 1/2009 Kim
2020/0003381 A1* 1/2020 Liao ..... F21S 41/153
2020/0072428 A1* 3/2020 Simchak ..... F21S 41/255

FOREIGN PATENT DOCUMENTS

AT 8253 U1 4/2006
CN 102834662 A * 12/2012 ..... F21S 41/143
(Continued)

OTHER PUBLICATIONS

International Search Report of the present application PCT/CN2020/073848 and English translation of written opinion therein.

*Primary Examiner* — Omar Rojas Cadima
(74) *Attorney, Agent, or Firm* — Volpe Koenig

(57) ABSTRACT

A vehicle lamp, a vehicle, and a vehicle lamp illumination module. The vehicle lamp illumination module comprises light sources, a low-beam primary optical element, a high-beam primary optical element, and a secondary optical element. The low-beam primary optical element can guide light to be sequentially emitted via the low-beam primary optical element and the secondary optical element to form a low-beam shape. The high-beam primary optical element comprises multiple collimation units, wherein the surfaces of light emitting ends of the collimation units are connected together or integrally formed to form a high-beam light
(Continued)

emitting surface. Light incident ends of the collimation units have one-to-one correspondence to the light sources, so that the light can be sequentially emitted via the high-beam primary optical element and the secondary optical element to form a lightless shape. The module has accurate light shape control, is precise in assembly, and high in light energy utilization.

9 Claims, 28 Drawing Sheets

(30) Foreign Application Priority Data

| | | |
|---|---|---|
| Apr. 15, 2019 | (CN) | 201910300171.9 |
| May 21, 2019 | (CN) | 201920738614.8 |
| May 22, 2019 | (CN) | 201910428378.4 |
| Jul. 11, 2019 | (CN) | 201921096137.6 |
| Sep. 27, 2019 | (CN) | 201910927121.3 |

(51) Int. Cl.

| | |
|---|---|
| ***F21S 41/275*** | (2018.01) |
| ***F21S 41/147*** | (2018.01) |
| ***F21S 41/32*** | (2018.01) |
| ***F21S 41/255*** | (2018.01) |
| ***F21S 41/43*** | (2018.01) |
| ***F21S 41/151*** | (2018.01) |
| ***F21V 17/10*** | (2006.01) |
| *F21W 102/13* | (2018.01) |
| *F21S 41/20* | (2018.01) |

(52) U.S. Cl.
CPC ..... *F21S 41/255* (2018.01); *F21S 41/275* (2018.01); *F21S 41/322* (2018.01); *F21S 41/43* (2018.01); *F21V 17/10* (2013.01); *F21S 41/285* (2018.01); *F21W 2102/13* (2018.01)

(58) Field of Classification Search
CPC ..... F21W 2102/13; F21W 2102/155; F21W 2102/16; F21W 2102/165; F21V 7/04
See application file for complete search history.

(56) References Cited

FOREIGN PATENT DOCUMENTS

| | | | | | |
|---|---|---|---|---|---|
| CN | 106016132 | A | | 10/2016 | |
| CN | 106439672 | A | | 2/2017 | |
| CN | 107664290 | A | | 2/2018 | |
| CN | 207962511 | U | | 10/2018 | |
| CN | 109268774 | A | | 1/2019 | |
| CN | 109681838 | A | | 4/2019 | |
| DE | 102007049835 | A1 | | 4/2009 | |
| DE | 102011077636 | A1 | * | 11/2011 | ..... B60Q 1/1423 |
| DE | 102012107426 | A1 | | 2/2014 | |
| DE | 102014118745 | A1 | | 6/2016 | |
| DE | 102015104514 | A1 | | 9/2016 | |
| EP | 2985522 | A1 | | 2/2016 | |
| EP | 3299703 | A1 | | 3/2018 | |
| EP | 3907427 | A1 | | 11/2021 | |
| JP | 2015035337 | A | * | 2/2015 | ..... F21S 48/1258 |
| JP | 2016212962 | A | | 12/2016 | |
| JP | 2018055907 | A | | 4/2018 | |
| JP | 2018098011 | A | | 6/2018 | |
| JP | 2019502245 | A | | 1/2019 | |
| WO | 2020211104 | A1 | | 10/2020 | |

* cited by examiner

VEHICLE LAMP ILLUMINATION MODULE, VEHICLE LAMP AND VEHICLE

FIELD OF THE INVENTION

Cross Reference to Related Applications

This application is a 35 USC § 371 National Stage application of International Patent Application No. PCT/CN2020/073848, which was filed Jan. 22, 2020, entitled "VEHICLE LAMP ILLUMINATION MODULE, VEHICLE LAMP AND VEHICLE," and claims priority to Chinese Patent Application No. 201910083832.7, filed Jan. 29, 2019; Chinese Patent Application No. 201910164892.1, filed Mar. 5, 2019; Chinese Patent Application No. 201920738614.8, filed May 21, 2019; Chinese Patent Application No. 201910428378.4, filed May 22, 2019; Chinese Patent Application No. 201921096137.6, filed Jul. 11, 2019; Chinese Patent Application No. 201910927121.3, filed Sep. 27, 2019; and Chinese Patent Application No. 201910300171.9, filed Apr. 15, 2019, all of which are incorporated herein by reference as if fully set forth.

The disclosure relates to a vehicle lamp illumination device, particularly relates to a vehicle lamp illumination module, and further relates to a vehicle lamp and a vehicle.

Background of the Invention

At present, vehicles are indispensable means of transport for human travel, and people can meet special conditions of bad sight such as foggy days and night in the process of using the vehicles. Under the condition, a driver can conveniently observe surrounding road conditions by using an illumination tool, and meanwhile, the illumination tool can also prompt vehicles or pedestrians running from the opposite side so as to reduce traffic accidents.

High-beam and low-beam lamps are common illumination tools in the running process of vehicles. High-beam lamps are generally needed for driving in open or dark places such as expressways or suburbs, but when vehicles need to meet in the opposite direction, the high-beam lamps need to be switched into low-beam lamps. Besides, the low-beam lamps are generally adopted for driving on urban roads, and potential safety hazards caused by the reason that the sight of drivers of the opposite running vehicles and pedestrians on the roads is affected due to too high angle of the high-beam lamps are prevented.

At present, a high-beam and low-beam integrated light emitting module is mostly used for an automobile headlamp, a low-beam condenser and a high-beam condenser are arranged in an up-and-down overlapping mode, dozens of light sources are integrated, the light shapes of the light sources are independent and cannot interfere with one another, the low-beam condenser or the high-beam condenser is required to be very delicate and compact, the result of the light shapes may be greatly influenced by a very small tolerance, the requirement on the tolerance of an optical element is high, and the requirement on the assembly precision is also high.

In view of the above-mentioned drawbacks in the prior art, a novel vehicle lamp illumination module needs to be designed.

SUMMARY OF THE INVENTION

The technical problem to be solved by the present disclosure is to provide a vehicle lamp illumination module which has accurate light shape control, and is accurate in assembly and high in light energy utilization rate.

Further, the technical problem to be solved by the present disclosure is to provide a vehicle lamp which has high light energy utilization rate, compact structure and stable optical performance.

Furthermore, the technical problem to be solved by the present disclosure is to provide a vehicle which has high light energy utilization rate, compact structure and stable optical performance.

In order to solve the above technical problems, a first aspect of the present disclosure provides a vehicle lamp illumination module which includes light sources, a low-beam primary optical element, a high-beam primary optical element and a secondary optical element, the low-beam primary optical element is configured to guide light to be sequentially emitted via the low-beam primary optical element and the secondary optical element to form a low-beam shape, the high-beam primary optical element includes multiple collimation units, the surfaces of light emitting ends of the collimation units are connected to each other or integrally formed to form a high-beam light emitting surface, and light incident ends of the collimation units have one-to-one correspondence to the light sources, so that the light can be sequentially emitted via the high-beam primary optical element and the secondary optical element to form a high-beam shape.

Optionally, the low-beam primary optical element includes a low-beam light incident surface, a low-beam light guide portion and a low-beam light emitting surface, the low-beam light guide portion is configured to guide the light received by the low-beam light incident surface to be emitted to the low-beam light emitting surface, a reflection portion is formed on a lower surface of the low-beam light guide portion, multiple light condensing structures which are sequentially arranged and have one-to-one correspondence to the light sources are mounted on the low-beam light incident surface, and a low-beam cut-off portion used for forming a low-beam shape cut-off line is formed on the low-beam primary optical element.

Optionally, the low-beam primary optical element includes a first light channel and a second light channel, a reflection surface which is arranged in an inclined manner is arranged between the first light channel and the second light channel, so that light can be reflected from the inside of the first light channel into the second light channel and be emitted from the low-beam light emitting surface at the front end of the second light channel, multiple light condensing structures which are sequentially arranged and have one-to-one correspondence to the light sources are mounted on the low-beam light incident surface on the first light channel, and a low-beam cut-off portion for forming a low-beam shape cut-off line is arranged on the second light channel.

Optionally, the low-beam primary optical element includes multiple light condensing structures and a reflection portion, the light condensing structures are sequentially arranged along the edge of the rear end of reflection portion and have one-to-one correspondence to the light sources, a low-beam cut-off portion used for forming a low-beam shape cut-off line is formed at the front end of the reflection portion, and the reflection portion is of a plate-shaped structure.

Further, the distance between the front end of the reflection portion and an upper boundary of the front end of the high-beam primary optical element is not greater than 2 mm.

Further, the low-beam light emitting surface is a concave curved surface adaptive to the focal plane of the secondary optical element.

Further, the size of the light condensing structures located in the middle region is greater than the size of the other light condensing structures located in the two side regions.

Further, the lower edge of the low-beam light emitting surface of the low-beam primary optical element is connected with the upper edge of the high-beam light emitting surface of the high-beam primary optical element, and a wedge-shaped gap which is gradually increased from front to rear is formed between the low-beam primary optical element and the high-beam primary optical element.

Specifically, the light condensing structure is of a light condensing cup structure with a cavity, a curved surface protrusion facing the light source is arranged in the cavity, or a light incident portion of the light condensing structure is of a light condensing cup structure of a plane, a convex curved surface or a concave curved surface.

Optionally, a structure formed by connecting light emitting ends of the collimation units or integrally formed by the light emitting ends of the collimation units is provided with a high-beam cut-off portion used for forming a high-beam shape cut-off line.

Optionally, the collimation unit includes a light incident end, a light passing portion and a light emitting end, the light passing portion of the collimation unit located in the middle portion of the high-beam primary optical element is connected with two light incident ends in the up-down direction, and the two light incident ends are configured to enable light to be emitted into the corresponding light passing portion.

Optionally, the high-beam primary optical element is connected with a radiator through a limiting structure.

Further, an included angle of which the gap is gradually reduced from rear to front is formed between the adjacent collimation units, and the adjacent collimation units are connected by a connecting rib.

Specifically, the limiting structure includes a pressing plate and a supporting frame, limiting pieces which can be inserted into the gaps between the corresponding adjacent collimation units are arranged on the supporting frame, and the pressing plate and the supporting frame limit the high-beam primary optical element therebetween through a connecting structure.

Optionally, protrusions which abut against the surface of the high-beam primary optical element are arranged on the pressing plate and the supporting frame.

Optionally, limiting protrusions for limiting left-right movement of the high-beam primary optical element are respectively arranged at the left end and the right end of the supporting frame.

Specifically, the connecting rib between the adjacent collimation units is clamped between the two limiting pieces.

Specifically, the limiting piece is of a circular truncated cone structure or a truncated pyramid structure of which the sectional area of the upper portion is smaller than the sectional area of the lower portion, and the cross-sectional shape of the limiting piece is adaptive to the cross-sectional shape of the gap between the corresponding adjacent collimation units.

Specifically, the connecting structure includes first buckles connected to two ends of the pressing plate and bayonets matched with the first buckles and located on the supporting frame.

Furthermore, a supporting frame front positioning surface and a supporting frame rear positioning surface which are coplanar are respectively arranged at the front end and the rear end of the supporting frame, a pressing plate front positioning surface and a pressing plate rear positioning surface which are coplanar are respectively arranged on the front portion and the rear portion of the pressing plate, the lower surfaces of the front portions of the collimation units are attached to the supporting frame front positioning surface, the lower surfaces of the rear portions of the collimation units are attached to the supporting frame rear positioning surface, the pressing plate front positioning surface is attached to the upper surfaces of the front portions of the collimation units, and the pressing plate rear positioning surface is attached to the upper surfaces of the rear portions of the collimation units, so that the degree of freedom of the high-beam primary optical element in the up-down direction can be limited.

Optionally, the connecting structure includes a positioning hole formed in one of the pressing plate and the supporting frame, a positioning pin formed on the other one of the pressing plate and the supporting frame and through holes formed in the pressing plate and the supporting frame and used for threaded connection.

Optionally, the lower end of the structure formed by connecting the light emitting ends of the collimation units or integrally formed by the light emitting ends of the collimation units extends to form a flange protrusion, and the flange protrusion is snap-fitted to a mounting groove on the supporting frame.

Optionally, the low-beam primary optical element also includes multiple collimation units, the light incident ends of the collimation units have one-to-one correspondence to the light sources, the light emitting ends of the collimation units of the low-beam primary optical element are connected with each other or integrally formed to form a low-beam light emitting surface, the light emitting ends of the collimation units of the high-beam primary optical element are connected to each other or integrally formed to form a high-beam light emitting surface, the high-beam primary optical element is connected with a radiator through a limiting structure, the limiting structure includes a mounting support, an upper limiting piece and a lower limiting piece, the low-beam primary optical element and the upper limiting piece for limiting the up-down direction of the low-beam primary optical element are sequentially mounted on the upper side of the mounting support from bottom to top, the high-beam primary optical element and the lower limiting piece for limiting the up-down direction of the high-beam primary optical element are sequentially mounted on the lower side of the mounting support from top to bottom, and horizontal limiting structures for limiting the horizontal direction of the low-beam primary optical element and the horizontal direction of the high-beam primary optical element are separately formed on the upper side and the lower side of the mounting support.

Specifically, multiple upper limiting bosses which are in local contact with the low-beam primary optical element are arranged on the bottom of the upper limiting piece, multiple lower limiting bosses which are in local contact with the high-beam primary optical element are arranged on the top of the lower limiting piece, the upper limiting piece and the lower limiting piece are in bolted connection with the mounting support, second buckles are separately arranged on the low-beam primary optical element and the high-beam primary optical element, and clamping structures which are matched with the second buckles are separately arranged on the upper side and the lower side of the mounting support.

More specifically, the horizontal limiting structure includes two rows of limiting columns, each limiting column is inserted into the gap between the corresponding adjacent collimation units, and the connecting rib between the adjacent collimation units is located between two adjacent limiting columns in the two rows of limiting columns.

Optionally, the high-beam light emitting surface of the high-beam primary optical element is a concave curved surface which is adaptive to the focal plane of the secondary optical element or a curved surface which is gradually bent towards the rear side from top to bottom.

Optionally, the included angle is 0-5 degrees.

Optionally, the light incident end of the collimation unit is of a light condensing cup structure with a cavity, a curved surface protrusion facing the light source is arranged in the cavity, or the light incident end of the collimation unit is of a light condensing cup structure of a plane, a convex curved surface or a concave curved surface.

Typically, the low-beam primary optical element and the high-beam primary optical element are transparent optical elements.

Optionally, the minimum distance from the low-beam primary optical element and the high-beam primary optical element to the focal point of the secondary optical element is less than or equal to 2 mm.

Specifically, a grid-like structure is arranged or integrally formed on the light emitting surface of the secondary optical element.

More specifically, a single grid unit in the grid-like structure is a convex curved surface, a concave curved surface or a plane.

More specifically, a single grid unit in the grid-like structure is rectangular, square, triangular or polygonal.

Optionally, the light incident surface of the secondary optical element is provided with a low-beam region III forming structure used for forming a region III light shape.

Specifically, the low-beam region III forming structure includes multiple longitudinal strip-shaped protrusions which extend in the up-down direction of the secondary optical element; or the low-beam region III forming structure includes multiple transverse strip-shaped protrusions which extend in the left-right direction of the secondary optical element; or the low-beam region III forming structure includes multiple block-shaped protrusions which are formed by connecting convex curved surfaces.

More specifically, the longitudinal cutting line of the light incident surface of each longitudinal strip-shaped protrusion is inclined towards a light emitting direction from top to bottom.

More specifically, the outer edge of the cross section of each longitudinal strip-shaped protrusion is a convex curve of which the central region is higher than the two side regions, the outer edge of the longitudinal section of each transverse strip-shaped protrusion is a convex curve of which the central region is higher than the two side regions.

Optionally, the widths of the longitudinal strip-shaped protrusions are equal, and the widths of the transverse strip-shaped protrusions are equal.

Optionally, the central region of each block-shaped protrusion is higher than the periphery region.

Specifically, the light incident surface of the secondary optical element is a plane or a convex curved surface.

Optionally, an upper portion and middle portion region of the light incident surface of the secondary optical element is a plane in the up-down direction, a lower portion region of the light incident surface of the secondary optical element is a plane which is inclined towards the light emitting direction from top to bottom, and the low-beam region III forming structure is located in the lower portion region.

Optionally, the low-beam region III forming structure includes a section of protrusion structure which is arranged on the light incident surface of the secondary optical element and is formed by connecting the multiple longitudinal strip-shaped protrusions, or the low-beam region III forming structure includes multiple longitudinal strip-shaped protrusions which are sequentially arranged from the left side edge of the light incident surface of the secondary optical element to the right side edge of the light incident surface of the secondary optical element.

Optionally, the widths of the transverse sections of the protrusion structure are gradually reduced from the middle to two sides.

A second aspect of the present disclosure provides a vehicle lamp, including the vehicle lamp illumination module according to the technical solution, a radiator and a lens mounting support, wherein the secondary optical element is a lens, and is connected with the radiator through the lens mounting support, and the vehicle lamp illumination module is mounted on the radiator, and is located in a cavity defined by the radiator and the lens mounting support.

A third aspect of the present disclosure provides a vehicle, including the vehicle lamp according to the technical solution.

Through the technical solution, the low-beam primary optical element and the high-beam primary optical element are arranged simultaneously, so that a high-beam and low-beam integrated design can be realized, light is propagated in the low-beam primary optical element and the high-beam primary optical element, and the light energy utilization efficiency is high; and moreover, the multiple collimation units are combined to form the design of the high-beam primary optical element, so that light shapes corresponding to the light sources can be independent of one another and do not interfere with one another, and the light shapes are relatively accurately controlled to fulfill a high-beam dazzling preventing function.

In addition, in the prior art, the low-beam region III forming structure is generally arranged below the low-beam primary optical element, because the front end of the low-beam primary optical element and the front end of the high-beam primary optical element are connected in the up-down direction, light from the low-beam region III forming structure cannot be emitted to the secondary optical element and projected to a low-beam region III light shape region, however, the low-beam region III forming structure is creatively arranged on the secondary optical element in the prevent disclosure, so that low-beam region III light shapes may not be affected by positional relationship between the low-beam primary optical element and the high-beam primary optical element.

Further advantages of the present disclosure, as well as technical effects of preferred embodiments, will be further described in the following Detailed Description of the Embodiments.

DESCRIPTION OF THE REFERENCE NUMERALS

Figure 1:
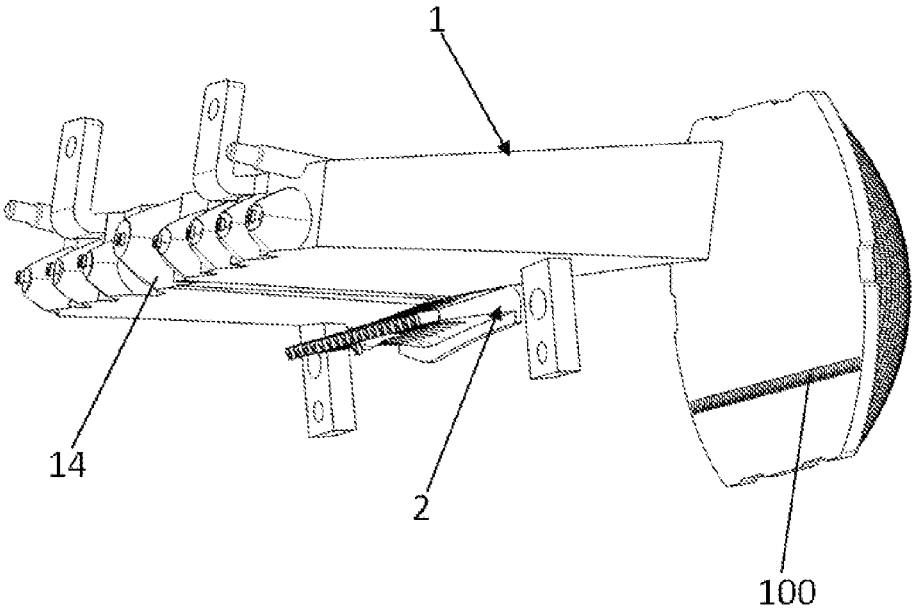
FIG. 1 is a first schematic diagram of a three-dimensional structure of the vehicle lamp illumination module according to a first embodiment of the present disclosure.

1-low-beam primary optical element
11-low-beam light emitting surface
12-low-beam light incident surface
13-low-beam light guide portion
14-light condensing structure
15-low-beam cut-off portion
16-first light channel
17-second light channel
18-reflection surface
19-reflection portion
2-high-beam primary optical element
21-collimation unit
211-connecting rib
22-high-beam light emitting surface
23-high-beam cut-off portion
24-flange protrusion
3 secondary optical element
31-upper portion and middle portion region
32-lower portion region
41-pressing plate
411-pressing plate front positioning surface
412-pressing plate rear positioning surface
42-supporting frame
421-limiting piece
422 limiting protrusion
423-supporting frame front positioning surface
424-supporting frame rear positioning surface
425-mounting groove
43-protrusion
44-first buckle
45-bayonet
51-mounting support
52-upper limiting piece
521-upper limiting boss
53-lower limiting piece
531-lower limiting boss
54-second buckle
55-limiting column
6-radiator
7-lens mounting support
100-low-beam region III forming structure
101-longitudinal strip-shaped protrusion
102-transverse strip-shaped protrusion
103-block-shaped protrusion

DETAILED DESCRIPTION OF THE EMBODIMENTS

Specific embodiments of the present disclosure will be described in detail below in conjunction with the accompanying drawings. It should be understood that the specific embodiments described herein are merely illustrative and explanatory of the present disclosure and are not intended to limit the present disclosure.

Furthermore, the terms "first", "second" are used for descriptive purposes only and are not to be construed as indicating or implying relative importance or implicitly indicating the number of technical features indicated, and thus a feature defined "first", "second" can include one or more of the features, either explicitly or implicitly.

In the description of the present disclosure, it is noted that, unless otherwise specifically stated or limited, the terms "mounted", "disposed", "connected", and the like are to be construed broadly, for example, connection can be fixed connection, detachable connection, or integral connection; connection can direct connection, indirect connection through an intermediate medium, internal communication between two elements, or an interactive relationship between two elements. Those skilled in the art can understand the specific meaning of the above terms in the present disclosure according to specific conditions.

It is to be understood that for the purpose of facilitating the description of the present disclosure and simplifying the description, the terms "front" and "rear" are intended to refer to the front-rear direction in the vehicle illumination direction, for example, a secondary optical element 3 is located in front, a low-beam primary optical element 1 is located in the rear relatively, the terms "left" and "right" are intended to refer to the left-right direction of the vehicle lamp illumination module in the vehicle illumination direction, and the terms "up" and "down" are intended to refer to the up-down direction of the vehicle lamp illumination module in the vehicle illumination direction. Generally, the front-rear direction, the left-right direction and the up-down direction of the vehicle lamp illumination module of the present disclosure generally correspond to the front-rear direction, the left-right direction and the up-down direction of the vehicle; the terms are based on the orientation or positional relationship shown in the drawings, and do not indicate or imply that the referred device or element must have a particular orientation and be configured and operated in a particular orientation, and therefore should not be construed as limiting the present disclosure; and moreover, the vehicle lamp illumination module can be installed in the vehicle in a variety of orientations such as a horizontal direction and a vertical direction, and the orientation terms for the vehicle lamp illumination module of the present disclosure should be understood in conjunction with the actual mounting state.

As shown in FIG. 1 to FIG. 39, a vehicle lamp illumination module according to a basic embodiment of the present disclosure includes light sources, a low-beam primary optical element 1, a high-beam primary optical element 2 and a secondary optical element 3, wherein the low-beam primary optical element 1 is configured to guide light to be sequentially emitted via the low-beam primary optical element 1 and the secondary optical element 3 to form a low-beam shape, the high-beam primary optical element 2 includes multiple collimation units 21, the surfaces of light emitting ends of the collimation units 21 are connected to each other or integrally formed to form a high-beam light emitting surface 22, and light incident ends of the collimation units 21 have one-to-one correspondence to the light sources, so that the light can be sequentially emitted via the high-beam primary optical element 2 and the secondary optical element 3 to form a high-beam shape.

Wherein, the secondary optical element 3 is generally a lens, such as a planoconvex lens and a biconvex lens, the low-beam primary optical element 1 and the high-beam primary optical element 2 are combined, thus, a low-beam shape and a high-beam shape can be formed respectively, and a high-beam and low-beam integrated function is fulfilled; light is propagated in the low-beam primary optical element 1 and the high-beam primary optical element 2, and the light emitted from the light sources is collected, so that loss of light energy can be reduced to a certain degree, and the light energy utilization rate is improved; moreover, other parts such as a reflector, a light shielding plate or a solenoid valve are not required to be arranged, so that reduction of the size of the vehicle lamp illumination module is facilitated, miniaturization design of the vehicle lamp illumination module is facilitated, and requirements of more vehicle lamp modellings are met; and the high-beam primary optical element 2 becomes a multi-channel light condensing element through the mode of combination of the multiple collimation units 21, an independent illumination region can be formed correspondingly, a high-beam dazzling preventing function is fulfilled through on and off of the light sources, and the light shape can be more accurately controlled to better meet the design requirement.

Figure 10:
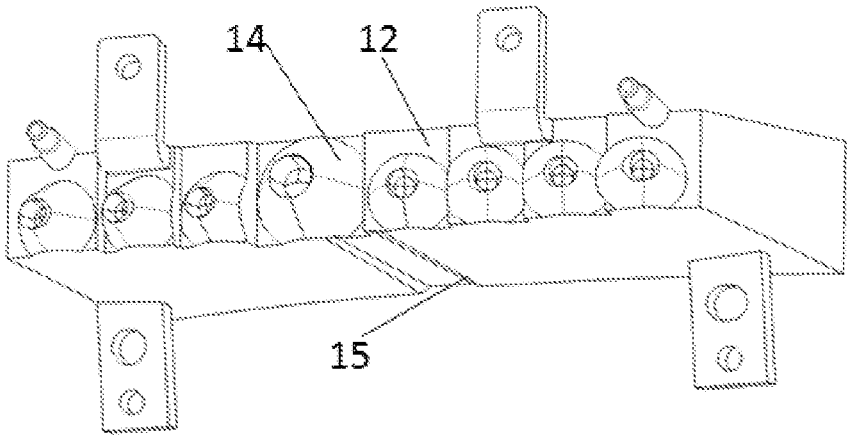
FIG. 10 is a first structural schematic diagram of the low-beam primary optical element according to an embodiment of the present disclosure.
Figure 11:
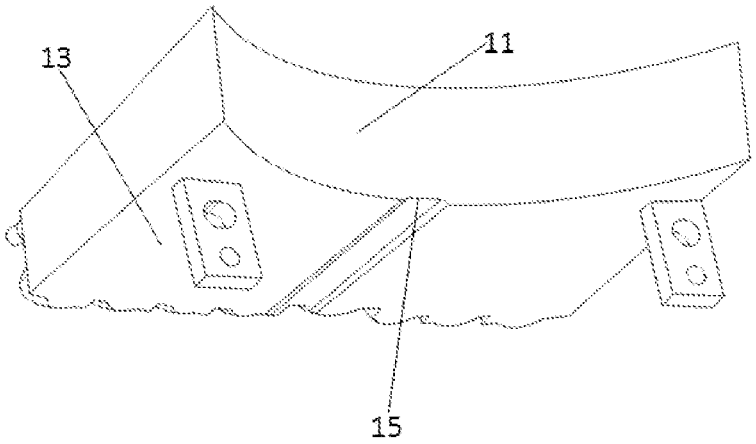
FIG. 11 is a second structural schematic diagram of the low-beam primary optical element according to an embodiment of the present disclosure.

A low-beam function can be fulfilled through various specific low-beam primary optical elements 1 in the present disclosure; specifically, as shown in FIG. 10 and FIG. 11, as an embodiment, the low-beam primary optical element 1 can include a low-beam light incident surface 12, a low-beam light guide portion 13 and a low-beam light emitting surface 11, which form a single-channel light condensing element, multiple light condensing structures 14 can be mounted on the low-beam light incident surface 12, the light condensing structures 14 are arranged in rows, correspondingly, the light sources have one-to-one correspondence to the light condensing structures 14, thus, the light emitted from the light sources is collected conveniently through the light condensing structures 14, the light enters the low-beam light guide portion 13 through the low-beam light incident surface 12 and then is emitted from the low-beam light emitting surface 11, and the light is cut off by a low-beam cut-off portion 15 arranged on the low-beam primary optical element 1, passes through the secondary optical element 3 again and then is emitted to a road surface to form a low-beam shape. In conjunction with FIG. 36 and FIG. 37, the lower surface of the low-beam light guide portion 13 can be provided with a reflection portion 19, thus, the light condensing structures 14 can collect light beams emitted from the light sources, the light beams are collimated and then are emitted into the low-beam light guide portion 13, part of the light entering the low-beam light guide portion 13 is directly emitted to the low-beam light emitting surface 11, the other part of the light is emitted to the reflection portion 19, the reflection portion 19 can reflect out the light to reuse the light, the light is propagated forwards to form effective light, and thus, light energy utilization efficiency is guaranteed.

Generally, the multiple light sources are arranged in a dispersed manner, due to the multiple dispersed light sources as heat sources, the thermal property can be greatly improved, and the heat dissipation property of the module is improved.

Figure 31:
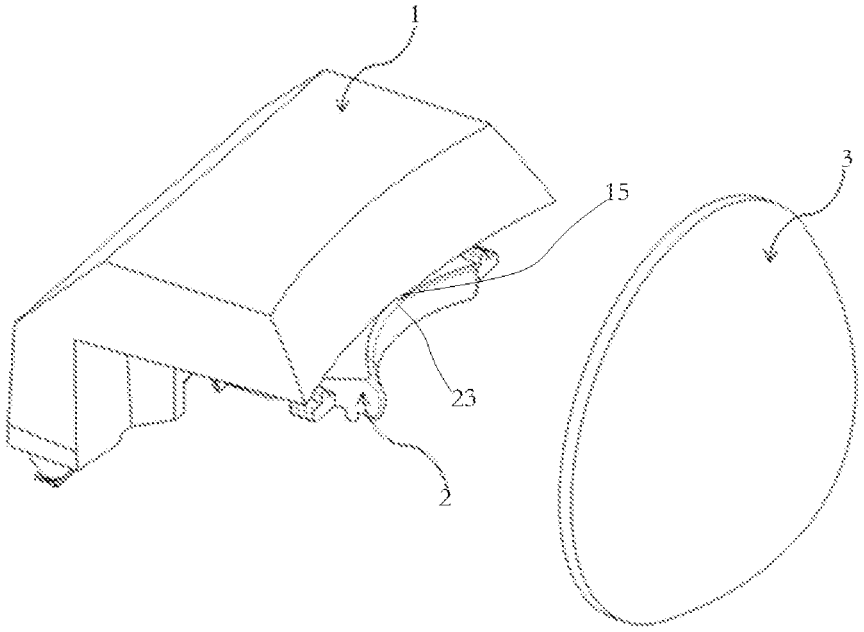
FIG. 31 is a first structural schematic diagram of the vehicle lamp illumination module according to a fourth embodiment of the present disclosure.
Figure 32:
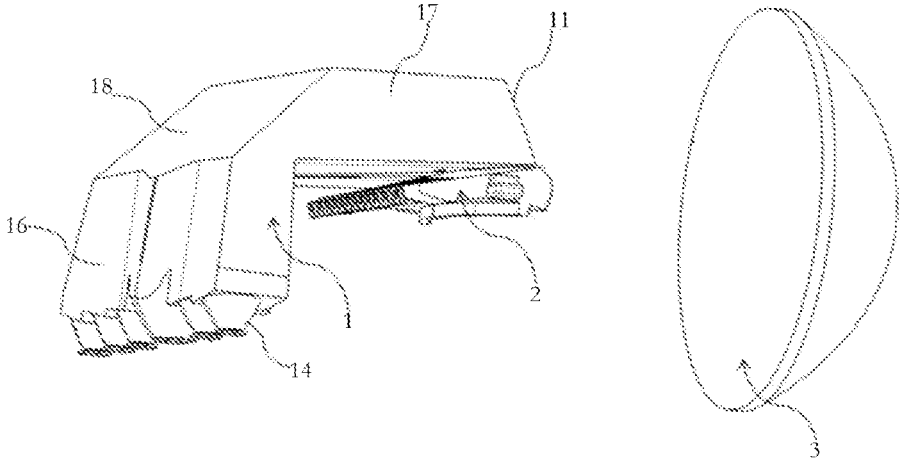
FIG. 32 is a second structural schematic diagram of the vehicle lamp illumination module according to the fourth embodiment of the present disclosure.

As another embodiment, referring to FIG. 31 and FIG. 32, the low-beam primary optical element 1 includes a first light channel 16 and a second light channel 17, a reflection surface 18 which is arranged in an inclined manner is arranged between the first light channel 16 and the second light channel 17, thus, the low-beam primary optical element 1 is bent, the reflection surface 18 is used for carrying out total reflection on the light of the first light channel 16 to enable the light to be utilized efficiently and to be continuously propagated in the second light channel 17, one end of the first light channel 16 is connected with the light condensing structures 14, the other end of the first light channel 16 is connected with the reflection surface 18 and the second light channel 17, the rear end of the second light channel 17 is connected with the reflection surface 18 while the front end of the second light channel 17 is provided with the low-beam light emitting surface 11, the light can be reflected into the second light channel 17 from the inside of the first light channel 16, and is emitted from the low-beam light emitting surface 11 at the front end of the second light channel 17, the multiple light condensing structures 14 which are sequentially arranged and have one-to-one correspondence to the light sources are mounted on the low-beam light incident surface 12 on the first light channel 16, and the second light channel 17 is provided with a low-beam cut-off portion 15 used for forming a low-beam shape cut-off line. When the first light channel 16 is described above, an up-down relationship is not defined due to the fact that the bent low-beam primary optical element 1 can be bent upwards, and can also be bent downwards, and the corresponding technical effect can be achieved no matter when the low-beam primary optical element 1 is bent upwards or bent downwards. It is required to be explained that those skilled in the art can also arrange the low-beam primary optical element 1 in a mode that only one second light channel 17 is arranged in the front-rear direction, and the low-beam primary optical element 1 is not bent to arrange the first light channel 16, by the manner, a low-beam function can also be fulfilled, but the manner has the defects that the size of the vehicle lamp illumination module in the front-rear direction cannot be further reduced; and in other words, according to the technical solution, the low-beam primary optical element 1 is bent, in this way, the size of the vehicle lamp illumination module in the front-rear direction is further reduced, and the characteristic of miniaturization can be achieved; and as a preferred solution, as shown in FIG. 31 and FIG. 32, the first light channel 16 extends from bottom to top, and the second light channel 17 extends from rear to front; and the first light channel 16 and the second light channel 17 both have certain length, so that light can be converged in a small angle range, and more light is propagated forwards, so that light energy is better utilized. The low-beam light emitting surface 11 can be a cambered surface, the radius of the low-beam light emitting surface 11 is 100 mm, the low-beam light emitting surface 11 is arranged to be cambered due to the fact that images of light shape of the light emitting surface with the cambered surface are clearer, specifically, the light at the position of a focal point of a lens is not converged into a point, if the light is converged into a point at the focal point of the lens and the point coincides with the focal point of the lens, the formed image is the clearest, a certain light shape needs to be formed, the light is light beams which are converged nearby the focal point of the lens and are diffused to a certain degree, when these light beams which are emitted from the low-beam primary optical element 1 are arc-shaped, the image after the light beams are refracted via the lens is the clearest, and thus, the low-beam light emitting surface 11 is arranged to be the cambered surface to enable the light to be converged in an arc-shaped manner when being emitted from the low-beam primary optical element 1 so as to obtain better images.

Figure 33:
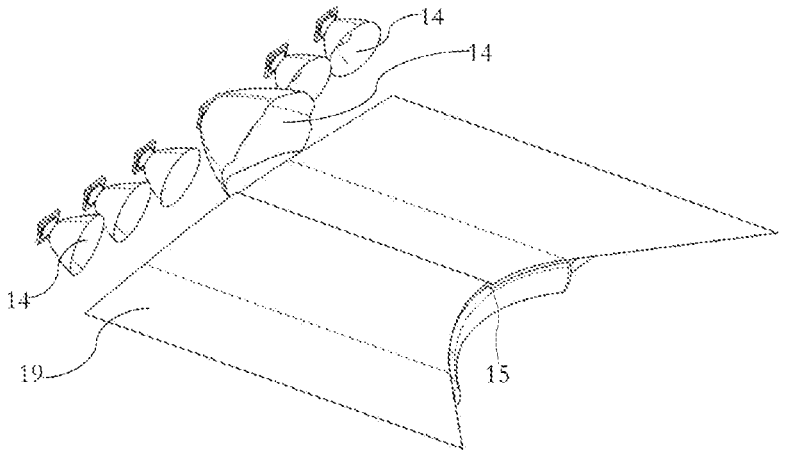
FIG. 33 is a first structural schematic diagram of the vehicle lamp illumination module according to a fifth embodiment of the present disclosure.
Figure 34:
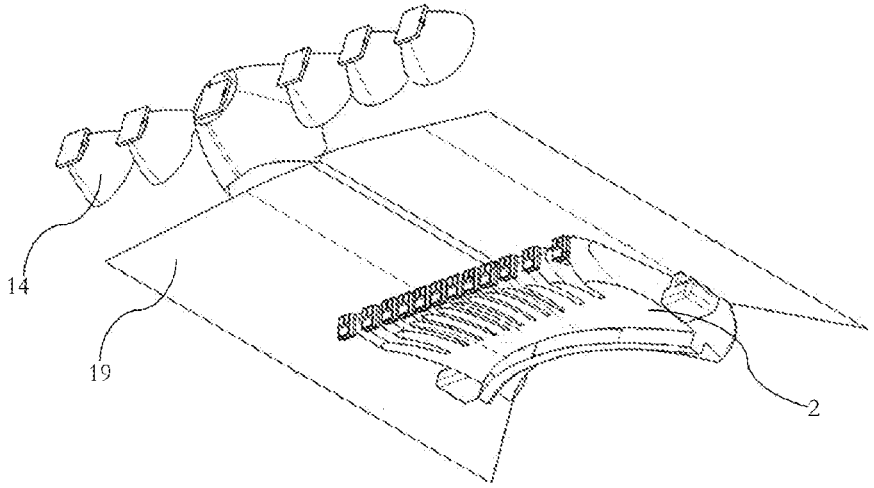
FIG. 34 is a second structural schematic diagram of the vehicle lamp illumination module according to the fifth embodiment of the present disclosure.
Figure 35:
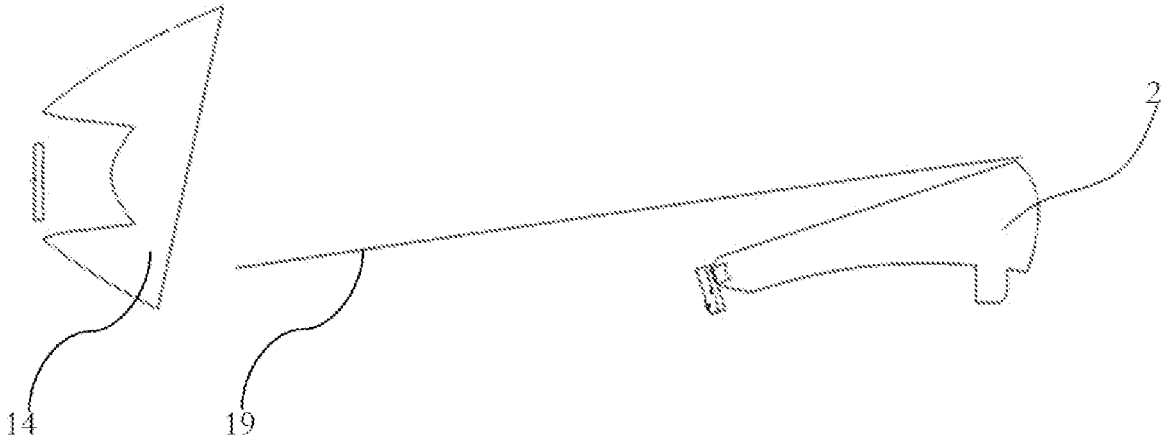
FIG. 35 is a third structural schematic diagram of the vehicle lamp illumination module according to the fifth embodiment of the present disclosure.
Figure 36:
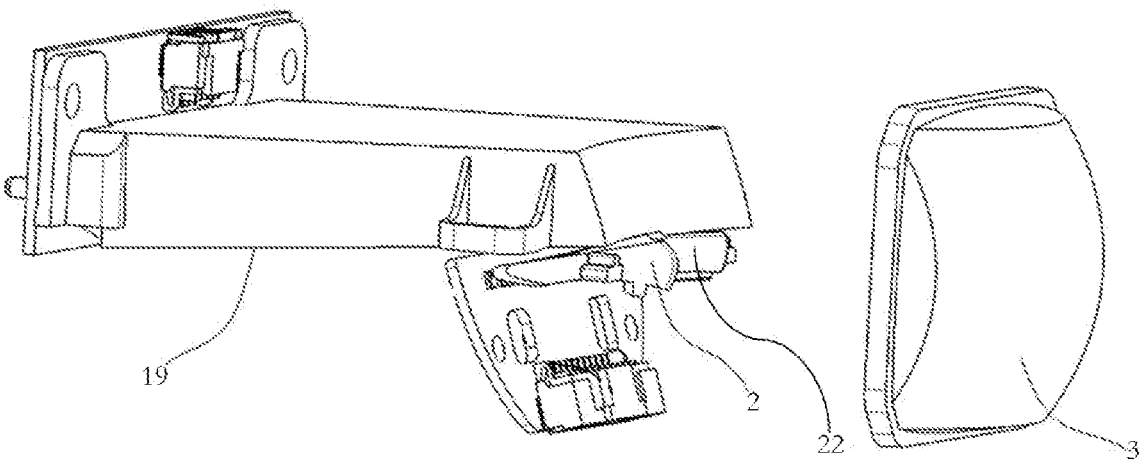
FIG. 36 is a structural schematic diagram of the vehicle lamp illumination module according to a sixth embodiment of the present disclosure.
Figure 37:
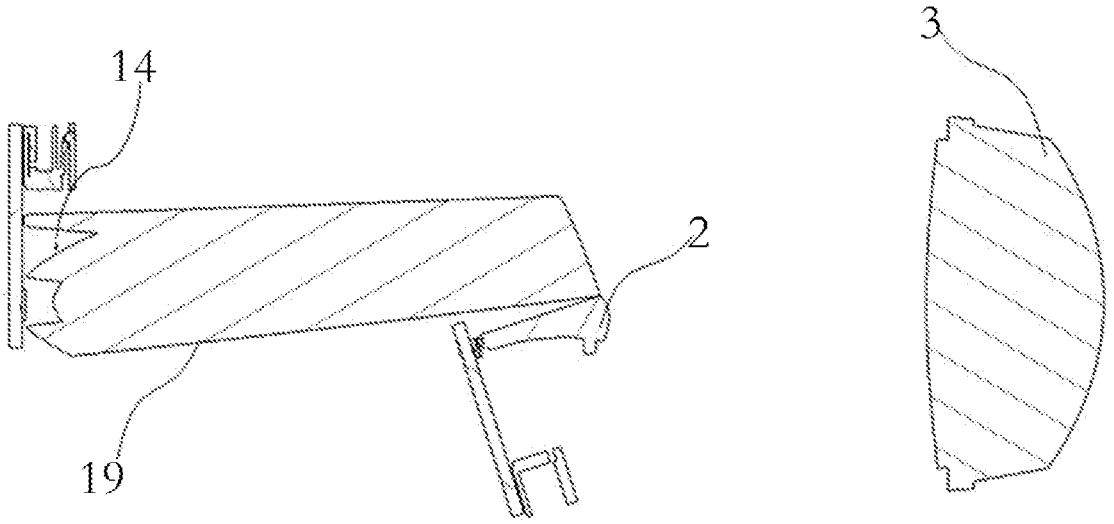
FIG. 37 is a longitudinal section view of the vehicle lamp illumination module according to the sixth embodiment of the present disclosure.

As another embodiment, as shown in FIG. 33 to FIG. 35, the low-beam primary optical element 1 includes multiple light condensing structures 14 and a reflection portion 19, the light condensing structures 14 are sequentially arranged along the edge of the rear end of the reflection portion 19, and have one-to-one correspondence to the light sources, the light sources are arranged at the positions capable of enabling generated low beams to penetrate through the corresponding light condensing structures 14, the number of the light sources can be set according to requirements of different optical properties, one low-beam primary optical element 1 is shared, and costs for research and development, manufacturing and the like can be reduced; the reflection portion 19 is of a plate-shaped structure, the thickness of the front end of the reflection portion 19 is not greater than 1 mm, the reflection portion 19 can be made of plastics or metal, the surface of the reflection portion 19 is subjected to aluminizing treatment to further improve the reflectivity, the light condensing structures 14 can collect light beams emitted from the light sources, collimate the light beams and then emit the collimated light beams, at the moment, part of the light beams can be emitted to the reflection portion 19, the reflection portion 19 can reflect out the light to reuse the light, the light is propagated forwards to form effective light, thus, the light energy utilization efficiency is guaranteed, the low-beam primary optical element 1 is arranged in a mode that the light condensing structures 14 and the reflection portion 19 are combined, and compared with a mode of independently using a reflector, the mode has the characteristic that the occupied space is small; the reflection portion 19 is arranged below the light emitting direction in the light emitting direction of the light condensing structures 14, the front end of the reflection portion 19 is connected with the low-beam light emitting surface 11, the low-beam cut-off portion 15 used for forming a low-beam shape cut-off line is formed at the front end of the reflection portion 19, the low-beam light emitting surface 11 can be a cambered surface, and the cambered surface can further adjust the emitted light shape to form a clear light shape; and the principle is as follows: the cambered surface is a concave curved surface which is adaptive to the focal plane of the secondary optical element 3, the focal plane is a plane which is orthogonal to the optical axis of the secondary optical element 3, but due to difference of curvature of field, the focal plane of the secondary optical element 3 is actually a curved surface which is concave rearwards, thus, the closer a portion of the low-beam light emitting surface 11 is to the focal plane, the clearer light pixels formed after the light emitted from the portion passes through the secondary optical element 3 are, in order to form the clear light shape, the low-beam light emitting surface 11 needs to be designed into the concave curved surface which is the same or roughly the same as the focal plane of the secondary optical element 3.

The light condensing structures 14 can generally be of light condensing cup structures with cavities, curved surface protrusions facing the light sources are arranged in the cavities, the emitting path of light can be controlled by adjusting the curvature of the side walls of the cavities and the curvature of the curved surface protrusions in the cavities, energy distribution of the output light shape is effectively adjusted, lots of adjustable structures exist, adjustment is facilitated, and light shape control is more accurate; of course, light incident portions of the light condensing structures 14 can be of light condensing cup structures of planes, convex curved surfaces or concave curved surfaces; and the light is collected better.

In addition, the low-beam light emitting surface 11 can be a concave curved surface which is adaptive to the focal plane of the secondary optical element 3, the focal plane refers to a plane which is orthogonal to the optical axis of the secondary optical element 3, but due to difference of curvature of field, the focal plane of the secondary optical element 3 is actually a curved surface which is concave rearwards, thus, the closer a portion of the low-beam light emitting surface 11 is to the focal plane, the clearer light pixels formed after the light emitted from the portion passes through the secondary optical element 3 are, in order to form a clear light shape, the low-beam light emitting surface 11 needs to be designed into a concave curved surface which is the same or roughly the same as the focal plane of the secondary optical element 3. Similarly, the above principle is also suitable for the high-beam light emitting surface 22 of the high-beam primary optical element 2, namely, the high-beam light emitting surface 22 can also be a concave curved surface which is adaptive to the focal plane of the secondary optical element 3.

Wherein, the upper boundary of the front end of the high-beam primary optical element 2 is in contact with the front end of the reflection portion 19, and thus, close connection and smooth excess between the low-beam shape and the high-beam shape can be realized well; and a certain gap can also be arranged between the low-beam shape and the high-beam shape, but the distance between the upper boundary of the front end of the high-beam primary optical element 2 and the front end of the reflection portion 19 is smaller than or equal to 2 mm so as to avoid uneven transition between the low-beam shape and the high-beam shape. The light sources which correspond to the low-beam primary optical element 1 and the high-beam primary optical element 2 respectively can be dispersed and are arranged into one row, thus, the heat sources can be more dispersed, heat dissipation of the light sources is facilitated, the heat dissipation property of the vehicle lamp illumination module is improved, and the service life of the vehicle lamp illumination module is prolonged. The illumination intensity of the middle of the low-beam shape is generally required to be higher than the illumination intensity of a side of the low-beam shape, and by multiple chips in the middle, the low-beam shape can meet the requirement better.

Further, the size of the light condensing structures 14 located in the middle region is greater than the size of the other light condensing structures 14 located on the two side regions, thus, the light condensing structures 14 in the middle region correspond to the multi-chip light sources, and the requirement of high illumination intensity in the middle region is met well.

Further, the lower edge of the low-beam light emitting surface 11 of the low-beam primary optical element 1 is connected with the upper edge of the high-beam light emitting surface 22 of the high-beam primary optical element 2, and a wedge-shaped gap which is gradually increased from front to rear is formed between the low-beam primary optical element 1 and the high-beam primary optical element 2; and thus, close connection and smooth and uniform transition between the low-beam shape and the high-beam shape can be realized.

Figure 2:
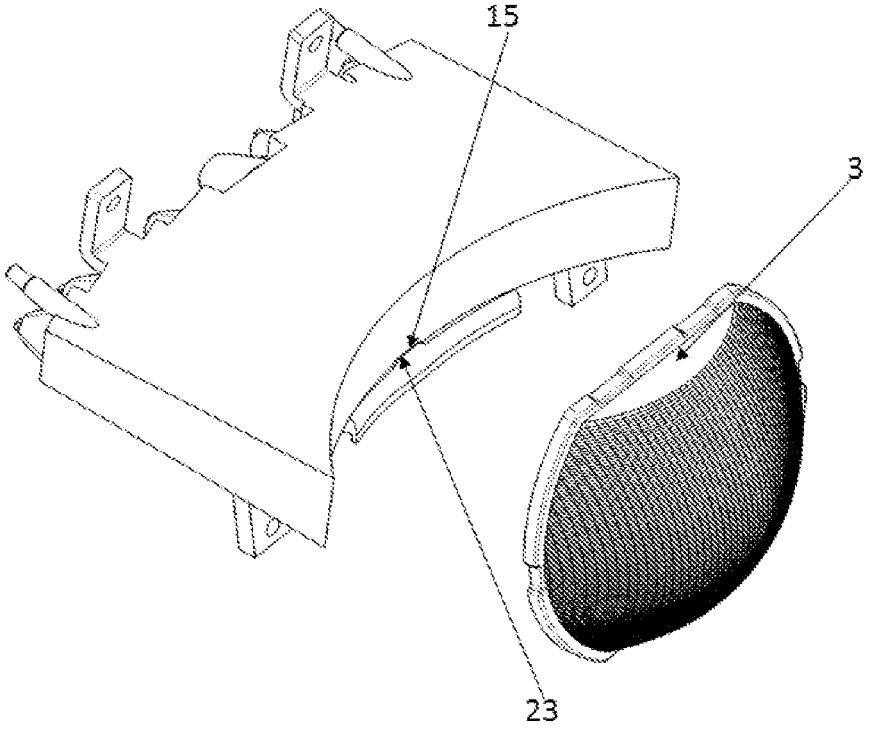
FIG. 2 is a second schematic diagram of a three-dimensional structure of the vehicle lamp illumination module according to the first embodiment of the present disclosure.

A high-beam cut-off portion 23 which is used for forming a high-beam shape cut-off line is arranged on the high-beam light emitting surface 22 formed by connecting light emitting end surfaces of the collimation units 21 or integrally formed by the light emitting end surfaces of the collimation units 21 of the high-beam primary optical element 2, as shown in FIG. 2, the low-beam cut-off portion 15 is connected with the high-beam cut-off portion 23, and thus, the low-beam shape and the high-beam shape are in close connection and smooth and uniform transition.

Figure 13:
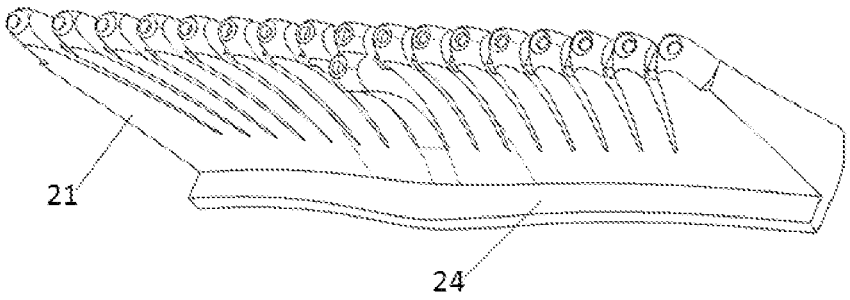
FIG. 13 is a second structural schematic diagram of the high-beam primary optical element according to an embodiment of the present disclosure.
Figure 14:
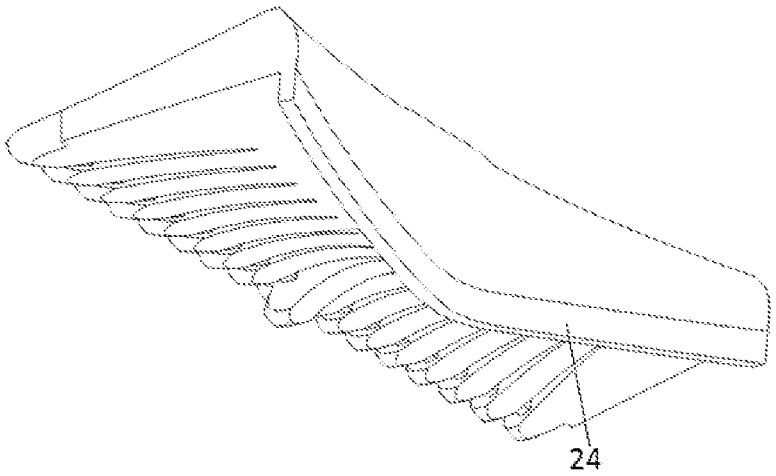
FIG. 14 is a third structural schematic diagram of the high-beam primary optical element according to an embodiment of the present disclosure.

In a specific embodiment, a collimation unit 21 includes a light incident end, a light passing portion and a light emitting end; further, referring to FIG. 13, the light passing portion of the collimation unit 21 located in the middle portion of the high-beam primary optical element 2 is connected with two light incident ends in the up-down direction, thus, a function which is equivalent to the function of the design that the light condensing structures 14 in the middle region correspond to the multi-chip light sources can be fulfilled, namely, more light can be emitted into the corresponding light passing portion through the two light incident ends, and the illumination intensity of the middle region of the high-beam shape is higher than the illumination intensity of other regions.

The low-beam primary optical element 1 and the high-beam primary optical element 2 can be mounted on a radiator 6 through various specific mounting structures, and generally, because most of light sources are in the mode of light emitting chips such as LED chips, a circuit board is generally arranged between the low-beam primary optical element 1 and the radiator 6 or between the high-beam primary optical element 2 and the radiator 6; and a limiting structure for mounting of the high-beam primary optical element 2 on the radiator 6 is mainly described below, and it will be understood that the low-beam primary optical element 1 can be mounted on the radiator 6 by using the limiting structure as well by simple conversion.

Figure 12:
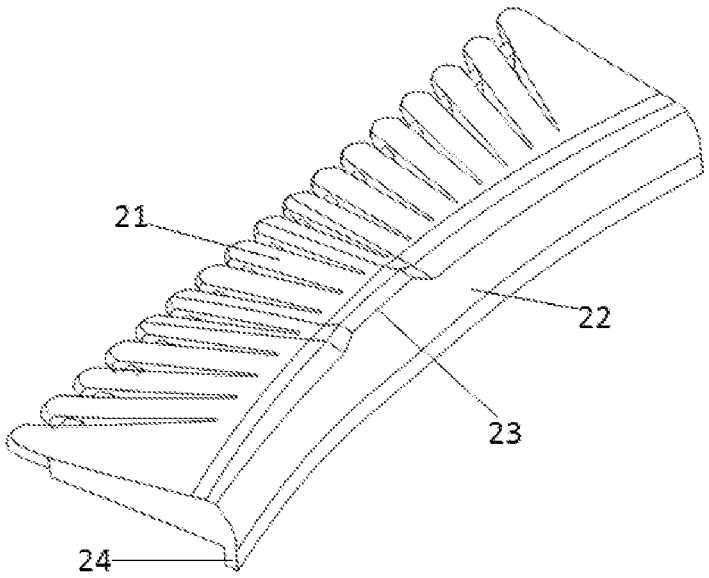
FIG. 12 is a first structural schematic diagram of the high-beam primary optical element according to an embodiment of the present disclosure.
Figure 23:
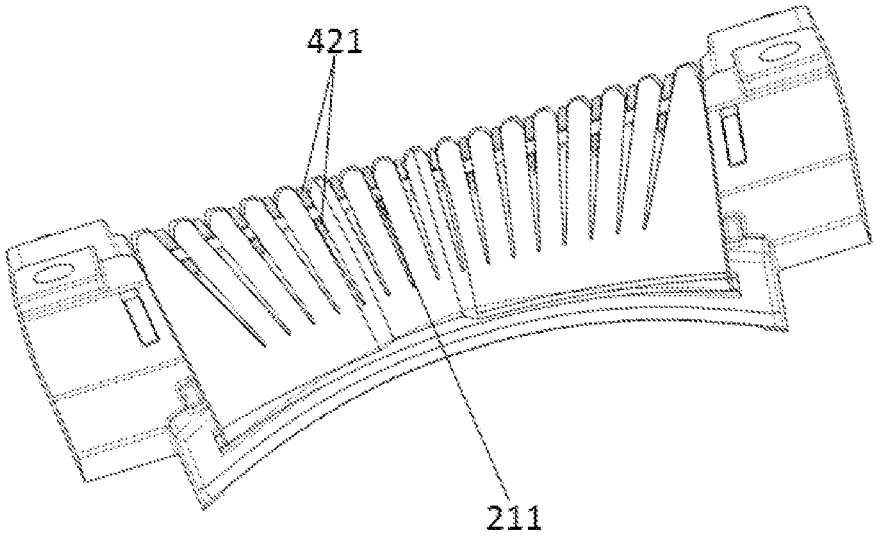
FIG. 23 is a sixth structural schematic diagram of the mounting mode of the high-beam primary optical element according to an embodiment of the present disclosure, wherein a pressing plate is not shown.
Figure 24:
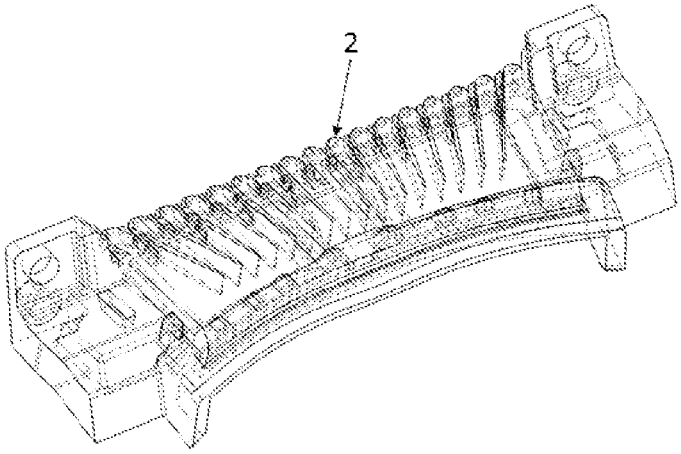
FIG. 24 is a seventh structural schematic diagram of the mounting mode of the high-beam primary optical element according to an embodiment of the present disclosure.

Referring to FIG. 12 and FIG. 23, in order to prevent light channeling and ensure independence of light shapes corresponding to the collimation units 21, an included angle of which a gap is gradually reduced from rear to front is formed between the adjacent collimation units 21, and meanwhile, in order to ensure structural stability, the adjacent collimation units 21 are connected by a connecting rib 211; and if a single included angle is too large, the angle of the collimation unit 21 at the extreme edge will be too large to affect the light emitting efficiency in consideration of the accumulation effect, and therefore, the included angle between the adjacent collimation units 21 is preferably 0-5 degrees.

Figure 15:
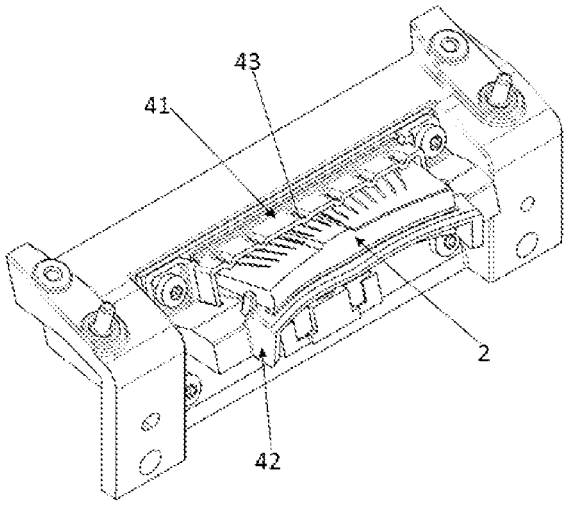
FIG. 15 is a first structural schematic diagram of a mounting mode of the high-beam primary optical element according to an embodiment of the present disclosure.
Figure 16:
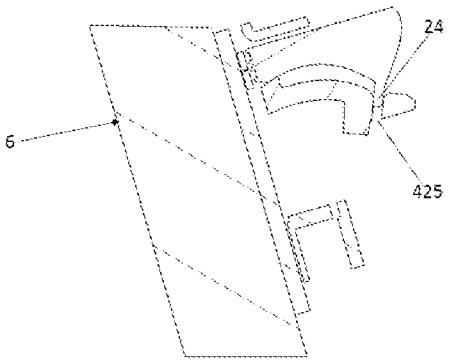
FIG. 16 is a cross-sectional view of the mounting mode of the high-beam primary optical element according to an embodiment of the present disclosure.
Figure 17:
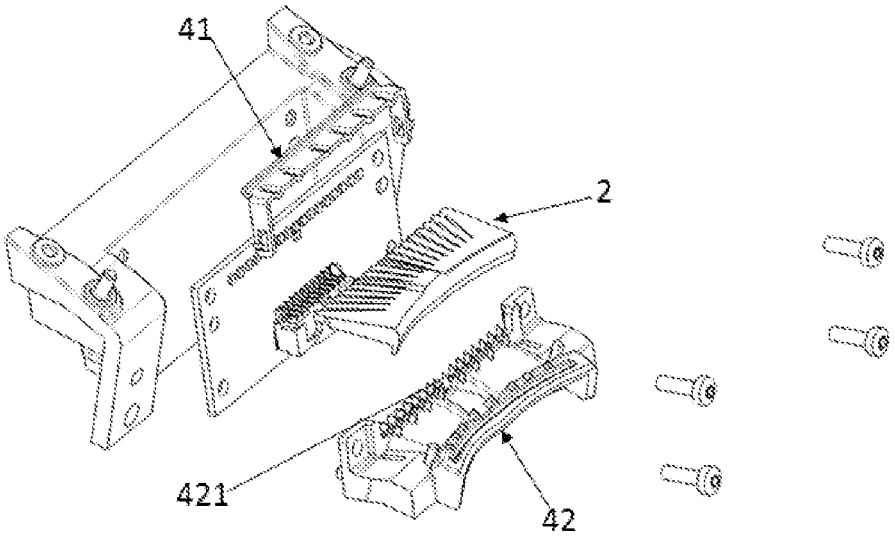
FIG. 17 is a first three-dimensional assembly exploded view of the high-beam primary optical element according to an embodiment of the present disclosure.
Figure 18:
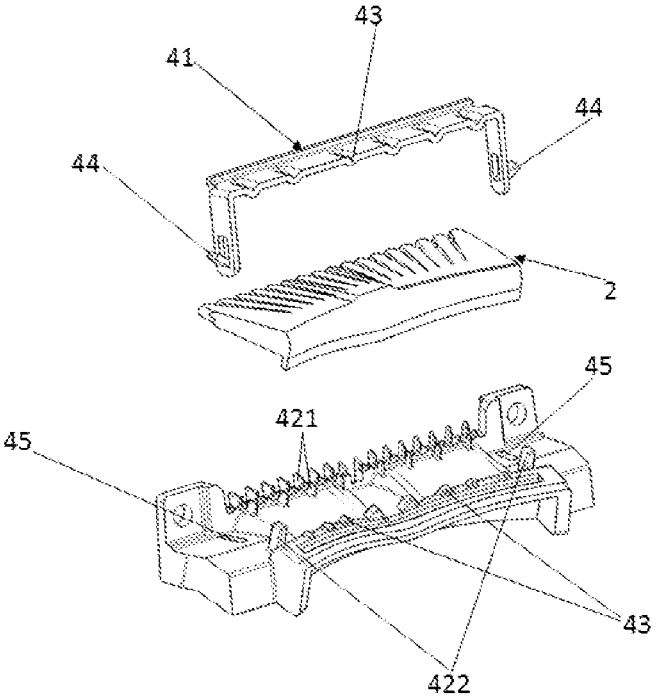
FIG. 18 is a second three-dimensional assembly exploded view of the high-beam primary optical element according to an embodiment of the present disclosure.
Figure 19:
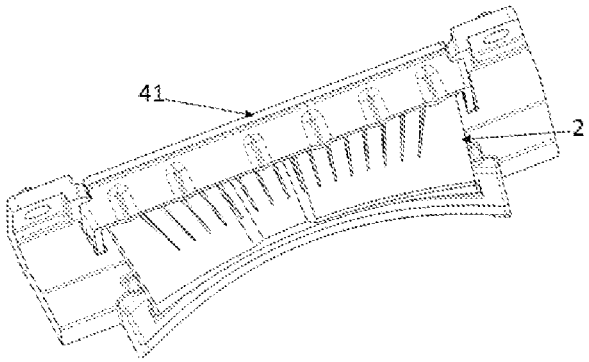
FIG. 19 is a second structural schematic diagram of the mounting mode of the high-beam primary optical element according to an embodiment of the present disclosure.
Figure 20:
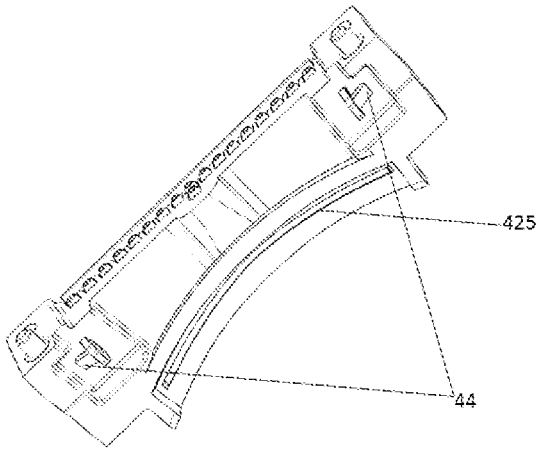
FIG. 20 is a third structural schematic diagram of the mounting mode of the high-beam primary optical element according to an embodiment of the present disclosure.
Figure 21:
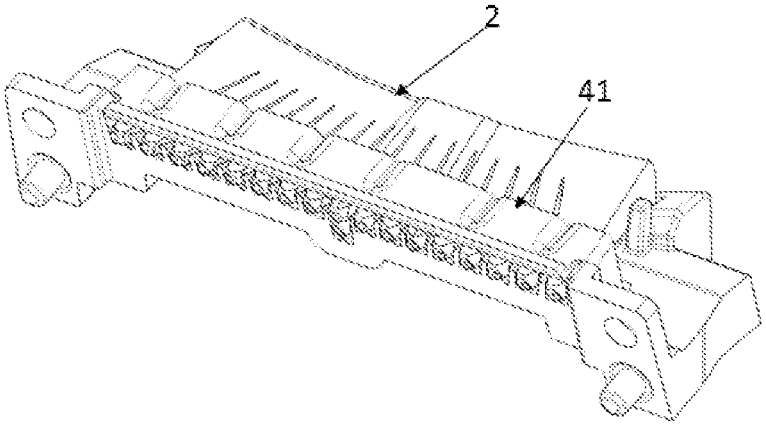
FIG. 21 is a fourth structural schematic diagram of the mounting mode of the high-beam primary optical element according to an embodiment of the present disclosure.
Figure 22:
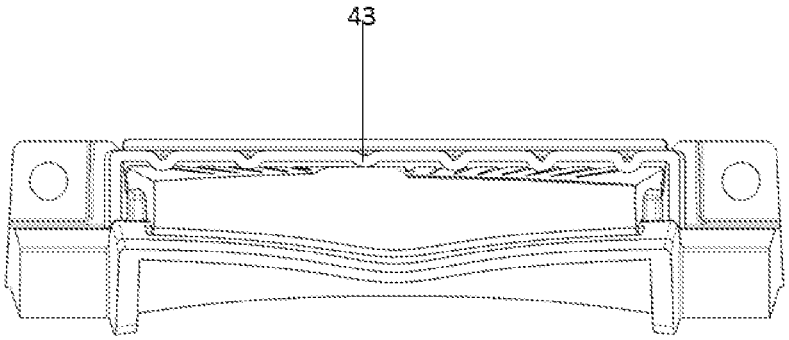
FIG. 22 is a fifth structural schematic diagram of the mounting mode of the high-beam primary optical element according to an embodiment of the present disclosure.

Correspondingly, as a specific embodiment, as shown in FIG. 17 and FIG. 18, the limiting structure includes a pressing plate 41 and a supporting frame 42, and limiting pieces 421 which can be inserted into gaps between the corresponding adjacent collimation units 21 are arranged on the supporting frame 42, so that the high-beam primary optical element 2 is limited and arranged between the pressing plate 41 and the supporting frame 42; further, each connecting rib 211 corresponds to two limiting pieces 421, thus, each connecting rib 211 is clamped between the two corresponding limiting pieces 421, and the degree of freedom in the front-rear direction of the high-beam primary optical element 2 is limited effectively; as shown in FIG. 15 and FIG. 18, protrusions 43 which abut against the surface of the high-beam primary optical element 2 are separately arranged on the pressing plate 41 and the supporting frame 42; by the protrusions 43, the pressing plate 41 and the supporting frame 42 are in local contact with the surface of the high-beam primary optical element 2, the requirement on the machining precision of a locally positioned part at a positioning place is high, the requirement on machining at a position where the part is not positioned can be reduced, therefore, integral contact is replaced by local contact, the machining cost can be reduced, when an actual product is poor in positioning and needs to be checked, the checking difficulty and the uncertain variables can be reduced, and moreover, modification and maintenance are facilitated; in addition, as shown in FIG. 18, first buckles 44 are further separately arranged at two ends of the pressing plate 41, and the first buckles 44 can be snap-fitted to bayonets 45 on the supporting frame 42 so as to fix the position of the high-beam primary optical element 2; referring to FIG. 18, limiting protrusions 422 can further be separately arranged at the left end and the right end of the supporting frame 42, and are used for limiting left-right movement of the high-beam primary optical element 2; and as shown in FIG. 16 and FIG. 20, the lower end of the structure formed by connecting the light emitting ends of the collimation units 21 or integrally formed by the light emitting ends of the collimation units 21 extends to form a flange protrusion 24, the flange protrusion 24 and a mounting groove 425 on the supporting frame 42 are snap-fitted, and thus, the high-beam primary optical element 2 can be further positioned.

Figure 38:
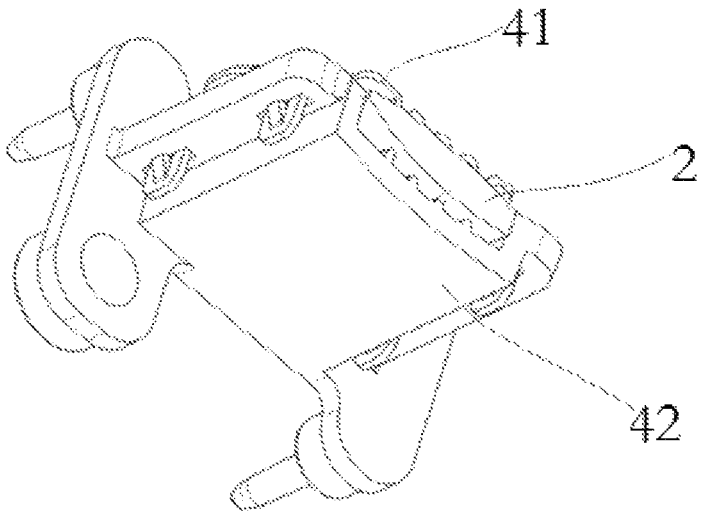
FIG. 38 is a structural schematic diagram of the mounting mode of the high-beam primary optical element according to a seventh embodiment of the prevent disclosure.
Figure 39:
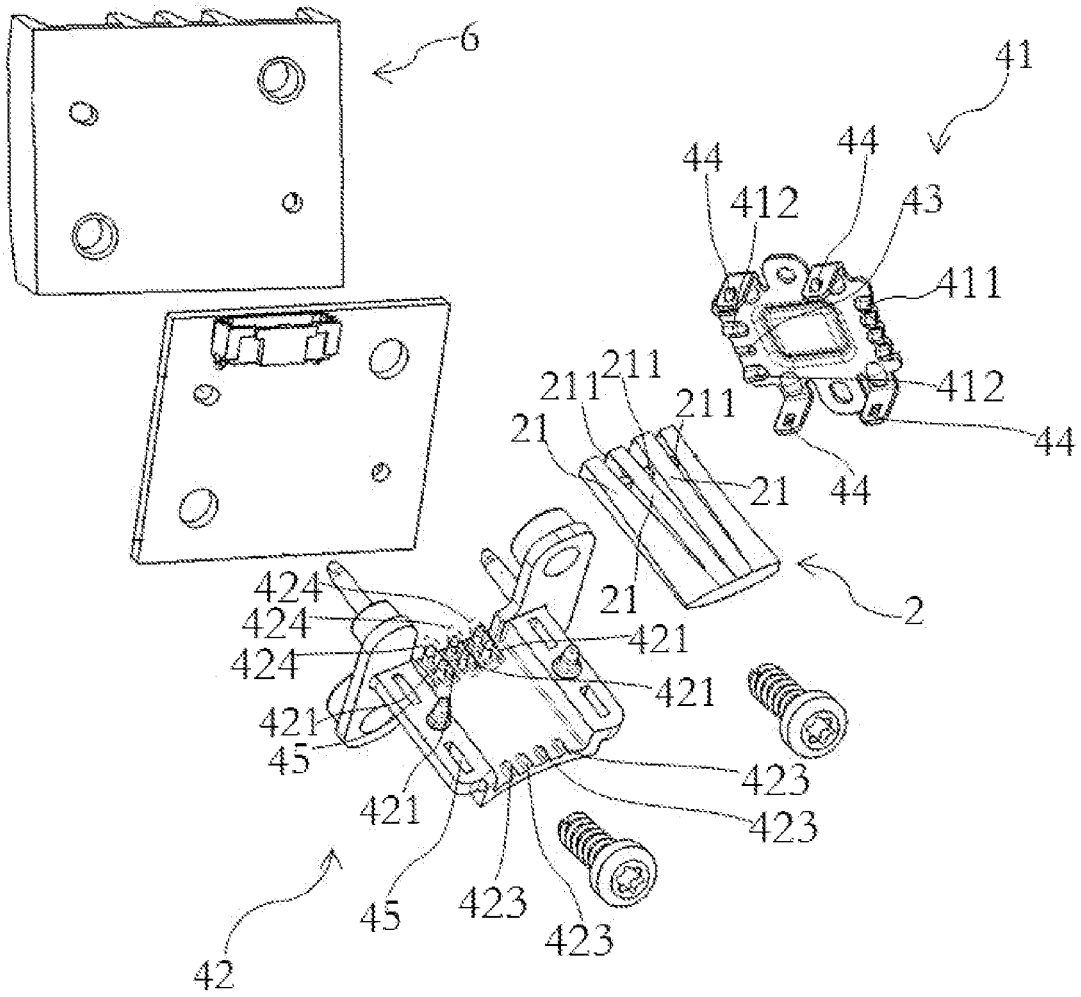
FIG. 39 is a three-dimensional assembly exploded view of the high-beam primary optical element according to the seventh embodiment of the present disclosure.

As another specific embodiment, as shown in FIG. 38 and FIG. 39, supporting frame front positioning surfaces 423 and supporting frame rear positioning surfaces 424 are separately arranged at the front end and the rear end of the supporting frame 42, the supporting frame front positioning surfaces 423 and the supporting frame rear positioning surfaces 424 are arranged on the same plane, pressing plate front positioning surfaces 411 and pressing plate rear positioning surfaces 412 are separately arranged on the front portion and the rear portion of the pressing plate 41, the pressing plate front positioning surfaces 411 and the pressing plate rear positioning surfaces 412 are arranged on the same plane, the lower surfaces of the front portions of the collimation units 21 are attached to the supporting frame front positioning surfaces 423, the lower surfaces of the rear portions of the collimation units 21 are attached to the supporting frame rear positioning surfaces 424, the pressing plate front positioning surfaces 411 are attached to the upper surfaces of the front portions of the collimation units 21, the pressing plate rear positioning surfaces 412 are attached to the upper surfaces of the rear portions of the collimation units 21, and thus, the degree of freedom in the up-down direction of the high-beam primary optical element 2 can be limited.

For the foregoing structure design, the precision of four planes of the pressing plate front positioning surface 411, the pressing plate rear positioning surface 412, the supporting frame front positioning surface 423 and the supporting frame rear positioning surface 424 is only required, the requirement on the precision of the rest portions is not high, by the design, manufacturing processes for a pressing plate 41 and a supporting frame 42 can be simplified, meanwhile, the manufacturing cost can also be reduced, meanwhile, even if the requirement on the precision of the four positioning planes is higher, the higher requirement can be met.

The precision of the various positioning planes is improved, correspondingly, the positioning precision of the high-beam primary optical element 2 is also improved, light passing through the high-beam primary optical element 2 can accurately achieve a desired effect, scrappage of parts is reduced, and the manufacturing cost is reduced.

Similarly, first buckles 44 are further separately arranged at two ends of the pressing plate 41, the first buckles 44 can be snap-fitted to the bayonets 45 on the supporting frame 42 so as to limit the up-down direction position of the high-beam primary optical element 2; and moreover, a limiting piece 421 can further be arranged into a circular truncated cone structure or a truncated pyramid structure of which the sectional area of the upper portion is smaller than the sectional area of the lower portion, and the cross-sectional shape of the limiting piece 421 is adaptive to the cross-sectional shape of the gap between the corresponding adjacent collimation units 21. By the small-top and large-bottom structure of the limiting piece 421, a gap between the two limiting pieces 421 can be large in top and small in bottom, thus, mounting of the connecting ribs 211 is facilitated, displacement is not easily caused in a daily using process, and the stability of the optical performance of the high-beam primary optical element 2 is guaranteed. The high-beam primary optical element 2 is used as a condenser, the limiting pieces 421 are inserted into the gaps between the corresponding adjacent collimation units 21 to limit the left-right direction of the high-beam primary optical element 2, meanwhile, the connecting ribs 211 are arranged between the two rows of limiting pieces 421 to limit the front-rear direction of the high-beam primary optical element 2, accurate positioning is achieved, relative positions of light incident ends of the collimation units 21 of the high-beam primary optical element 2 and the light sources and the position relation of the collimation units 21 are guaranteed effectively, thus, excessive light efficiency loss caused by inaccurate positioning and light pattern distortion caused by deformation of the high-beam primary optical element 2 are not easily caused, moreover, traditional front-rear pressing-in mounting of the condenser is changed into up-down pressing-in mounting, the mounting travel is reduced effectively, up-down pressing-in mounting more conforms to structural characteristics of the condenser, and the condenser is convenient to install.

Figure 27:
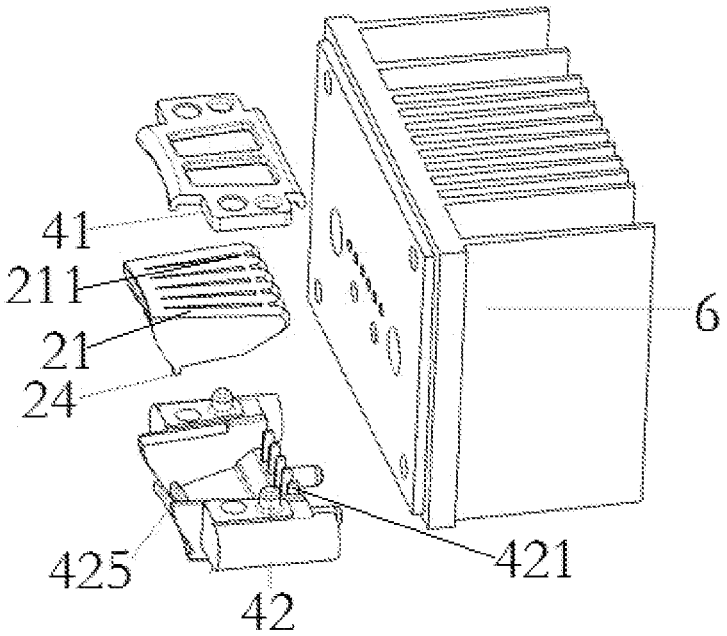
FIG. 27 is a three-dimensional assembly exploded view of the high-beam primary optical element according to a second embodiment of the present disclosure.

As another specific embodiment, as shown in FIG. 27, a limiting structure includes a pressing plate 41 and a supporting frame 42, the supporting frame 42 is provided with a groove structure for mounting the high-beam primary optical element 2, the high-beam primary optical element 2 is located between the supporting frame 42 and the pressing plate 41, light incident ends of the collimator units 21 have one-to-one correspondence to LED light sources, the front edge and the rear edge of the pressing plate 41 separately extend to form folded edges, and the two folded edges can be separately and correspondingly clamped to the edges of the front end and the rear end of the high-beam primary optical element 2, so that vibration and movement of the high-beam primary optical element 2 can be limited; multiple limiting pieces 421 are further arranged at the rear end of the groove structure, the limiting pieces 421 are separately inserted into the gaps between the corresponding adjacent collimation units 21, the relative positions of the collimation units 21 can be limited, it is ensured that the relative position relations of the collimation units 21 are always consistent, the circumstance that deformation is easily caused by vibration or extrusion is avoided, and the stability is better; and a mounting groove 425 is arranged at the front end of the groove structure, the mounting groove 425 can be in snap-fit connection with a flange protrusion 24 to fix the mounting position of the high-beam primary optical element 2 on the supporting frame 42, the circumstance that the high-beam primary optical element 2 deviates due to vibration is avoided, due to light guiding of the high-beam primary optical element 2, part of light can also be emitted from the flange protrusion 24, and the supporting frame 42 can further effectively prevent the light from being emitted from the flange protrusion 24; and the high-beam light emitting surface 22 of the high-beam primary optical element 2 can be in the design of a curved surface which is gradually bent towards the rear side from top to bottom, within a certain curvature range, the greater the curvature is, the more concentrated the light is, thus, more light is refracted to the secondary optical element 3, and the light energy utilization rate is high.

Moreover, in addition to the connection manner of snap-fitting the first buckles 44 to the bayonets 45, other connection manners of adopting positioning holes and positioning pins and the like may be adopted to realize connection and fixation between the pressing plate 41 and the supporting frame 42, for example, a connecting structure includes a positioning hole formed in one of the pressing plate 41 and the supporting frame 42 and a positioning pin formed on the other one of the pressing plate 41 and the supporting frame 42, and further includes through holes which are formed in the pressing plate 41 and the supporting frame 42 and used for threaded connection, and the pressing plate 41 is fixed on the supporting frame 42 by enabling bolts to pass through the through holes.

It should be noted that the primary optical elements play a great role in a vehicle lamp illumination effect, and the positioning and mounting reliability of the primary optical elements greatly affects the precision of the light shape of a vehicle lamp and the vehicle lamp illumination effect; meanwhile, any component arranged on the primary optical elements may influence primary distribution of light, and excessive mounting structures and positioning structures may generate more or less influence on the light distribution effect of the primary optical elements; and therefore, through arrangement of the limiting structure, the number of mounting structures and positioning structures on the low-beam primary optical element 1 and the high-beam primary optical element 2 can be reduced.

Figure 28:
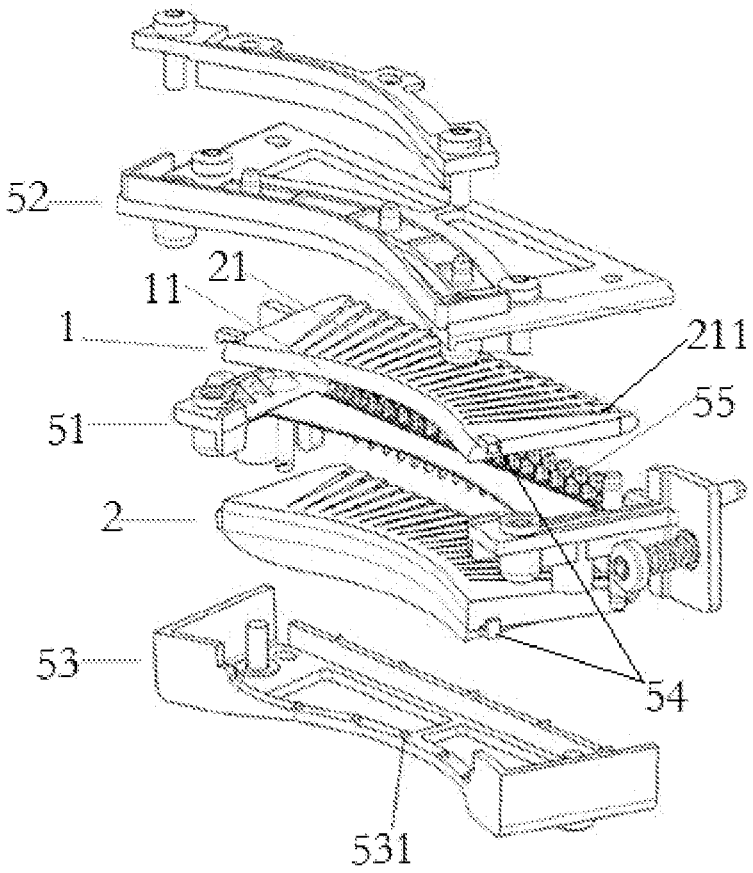
FIG. 28 is a three-dimensional assembly exploded view of the low-beam primary optical element and the high-beam primary optical element according to a third embodiment of the prevent disclosure.
Figure 29:
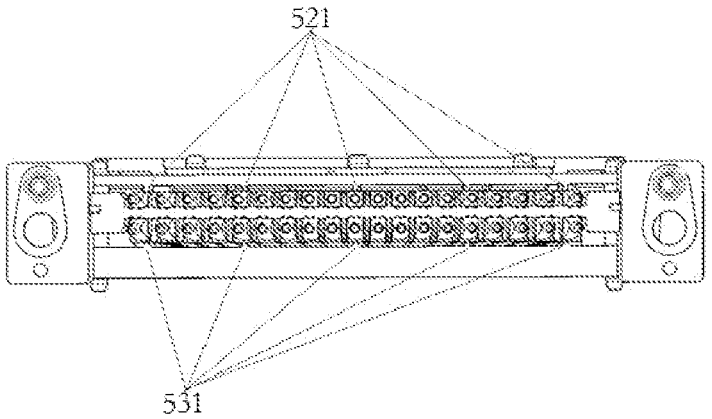
FIG. 29 is a first structural schematic diagram of mounting modes of the low-beam primary optical element and the high-beam primary optical element according to a third embodiment of the present disclosure.
Figure 30:
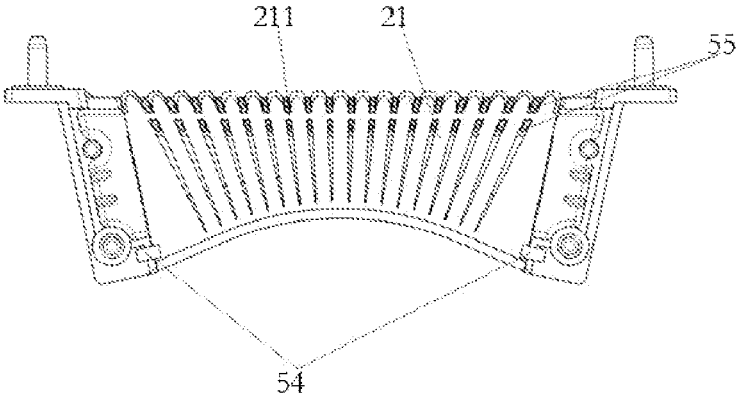
FIG. 30 is a second structural schematic diagram of the mounting modes of the low-beam primary optical element and the high-beam primary optical element according to the third embodiment of the present disclosure.

In a specific embodiment, as shown in FIG. 28 to FIG. 30, the low-beam primary optical element 1 may also be composed of multiple collimation units 21, the light incident ends of the collimation units 21 have one-to-one correspondence to the light sources, an included angle with the gap gradually reduced from rear to front is formed between the adjacent collimation units 21, and the adjacent collimation units 21 are connected by a connecting rib 211; the light emitting ends of the collimation units 21 of the low-beam primary optical element 1 are connected with each other or integrally formed to form the low-beam light emitting surface 11, the light emitting ends of the collimation units 21 of the high-beam primary optical element 2 are connected with each other or integrally formed to form the high-beam light emitting surface 22, the high-beam primary optical element 2 is connected with the radiator 6 through the limiting structure, the limiting structure includes a mounting support 51, an upper limiting piece 52 and a lower limiting piece 53, the low-beam primary optical element 1 and the upper limiting piece 52 for limiting the up-down direction of the low-beam primary optical element 1 are sequentially mounted on the upper side of the mounting support 51 from bottom to top, the high-beam primary optical element 2 and the lower limiting piece 53 for limiting the up-down direction of the high-beam primary optical element 2 are sequentially mounted on the lower side of the mounting support 51 from top to bottom, and horizontal limiting structures used for limiting the horizontal direction of the low-beam primary optical element 1 and the horizontal direction of the high-beam primary optical element 2 are formed on the upper side and the lower side of the mounting support 53.

Two rows of light spots can be formed by arrangement of the low-beam primary optical element 1 and the high-beam primary optical element 2, one row of light spots formed by the low-beam primary optical element 1 is used for low-beam follow-up steering, and one row of light spots formed by the high-beam primary optical element 2 is used as anti-dazzling high beam. The light incident end of each collimation unit 21 in the low-beam primary optical element 1 and the high-beam primary optical element 2 corresponds to one light source, and the light incident ends of the adjacent collimation units 21 are connected by a connecting rib 211; the light emitted by the light sources enters the collimation units 21 via the light incident ends of the collimation units 21 and is emitted from the light emitting surface, and the light emitting ends of the collimation units 21 are converged together, so that the low-beam primary optical element 1 and the high-beam primary optical element 2 have a converging effect on the light emitted by the light sources. In addition, the overall shape of a single collimation unit 21 is similar to the shape of a rectangular columnar structure, the light emitting ends of the collimation units 21 are connected with one another to form a light emitting surface, the light incident ends of the collimation units 21 need to be separated from one another to prevent light channeling, independence of the light shapes of the collimation units 21 is guaranteed, therefore, an included angle is designed between the adjacent collimation units 21, if a single included angle is too large, under the consideration of the accumulation effect, the angle of the collimation unit 21 at the extreme edge will be quite large, the light emitting efficiency is affected, and therefore, the included angle between the adjacent collimation units 21 is preferably 0-5 degrees.

The bottom of the upper limiting piece 52 is provided with multiple upper limiting bosses 521 which are in local contact with the low-beam primary optical element 1, the top of the lower limiting piece 53 is provided with multiple lower limiting bosses 531 which are in local contact with the high-beam primary optical element 2, and the upper limiting piece 52 and the lower limiting piece 53 are in bolted connection with the mounting support 51; due to the fact that the requirement on the machining precision of a locally positioned part at a positioning place is high, the requirement on machining at a position where the part is not positioned can be reduced, integral contact is replaced by local contact, the machining cost can be reduced, when an actual product is poor in positioning and needs to be checked, checking difficulty can be reduced, uncertain variables can be reduced, and modification and maintenance are facilitated; second buckles 54 are arranged on the low-beam primary optical element 1 and the high-beam primary optical element 2, clamping structures matched with the second buckles 54 are arranged on the upper side and the lower side of the mounting support 51, the clamping structures are clamping grooves or steps, clamping hooks matched with the clamping grooves or steps are arranged at one ends of the second buckles 54, preferably, the second buckles 54 are respectively arranged on two sides of the light emitting end of the low-beam primary optical element 1 and two sides of the light emitting end of the high-beam primary optical element 2, after the light emitting end of the low-beam primary optical element 1 and the light emitting end of the high-beam primary optical element 2 are respectively positioned and mounted on the upper side and the lower side of the mounting support 51, the light emitting end of the low-beam primary optical element 1 and the light emitting end of the high-beam primary optical element 2 are fixed on the mounting support 51 through the second buckles 54, so that the light incident ends and the light emitting ends of the low-beam primary optical element 1 and the high-beam primary optical element 2 are effectively positioned, and the mounting accuracy of the low-beam primary optical element 1 and the mounting accuracy of the high-beam primary optical element 2 are effectively ensured.

The low-beam primary optical element 1 and the high-beam primary optical element 2 may be condensers, a horizontal limiting structure includes two rows of limiting columns 55, and each limiting column 55 is inserted into a gap between the light incident ends of the corresponding adjacent collimation units 21, and the connecting rib 211 between the adjacent collimation units 21 is located between two adjacent limiting columns 55 in the two rows of limiting columns 55. During mounting, the low-beam primary optical element 1 is pressed in from the upper portion of the mounting support 51, so that gaps between the light incident ends of the adjacent collimation units 21 of the low-beam primary optical element 1 correspond to the limiting columns 55 on the upper side of the mounting support 51, the limiting columns 55 are inserted into the gaps between the light incident ends of the corresponding adjacent collimation units 21, and the connecting ribs 211 are located between the two rows of limiting columns 55; and the high-beam primary optical element 2 is pressed in from the lower portion of the mounting support 51, similarly, gaps between the light incident ends of the adjacent collimation units 21 of the high-beam primary optical element 2 correspond to the limiting columns 55 on the lower side of the mounting support 51, the limiting columns 55 are inserted into the gaps between the light incident ends of the corresponding adjacent collimation units 21, and the connecting ribs 211 are located between the two rows of limiting columns 55.

The left-right directions of the low-beam primary optical element 1 and the high-beam primary optical element 2 are limited by inserting the limiting columns 55 into the gaps between the light incident ends of the corresponding adjacent collimation units 21, and the front-rear directions of the low-beam primary optical element 1 and the high-beam primary optical element 2 are limited by arranging the connecting ribs 211 between the two rows of limiting columns 55, accurate positioning is achieved, the relative positions between the light incident ends of the collimation units 21 of the low-beam primary optical element 1 and the high-beam primary optical element 2 and the light sources as well as the position relation between the collimation units 21 are effectively ensured, therefore, excessive light efficiency loss caused by inaccurate positioning and light shape distortion caused by deformation of the low-beam primary optical element 1 and the high-beam primary optical element 2 are not easily caused, in addition, traditional front-rear press-in mounting of a condenser is changed into up-down press-in mounting, the mounting travel is effectively reduced, the up-down press-in mounting more conforms to the structural characteristics of the condenser, and thus, the condenser is convenient to mount.

The light incident end of each collimation unit 21 is also a light condensing device and may be of a light condensing cup structure with a cavity, a curved surface protrusion facing the light source is arranged in the cavity, the light emitting path can be controlled by adjusting the curvature of the side wall of the cavity and the curvature of the curved surface protrusion in the cavity, and energy distribution of the output light shapes is effectively adjusted, multiple adjustable structures are provided, adjustment is facilitated, and light shape control is more accurate; or the light incident end of each collimation unit 21 is of a light condensing cup structure of a plane, a convex curved surface or a concave curved surface, so that the light can be better collected.

In general, the low-beam primary optical element 1 and the high-beam primary optical element 2 may be transparent optical elements, for example, the low-beam primary optical element 1 and the high-beam primary optical element 2 are transparent optical elements made of transparent PC polycarbonate, PMMA material organic glass, silica gel or glass and the like.

In a specific embodiment, the front end of the low-beam primary optical element 1 and the front end of the high-beam primary optical element 2 are in contact with each other and are arranged at the lens focus of the secondary optical element 3 to obtain a clear image, and those skilled in the art may also set that the front end of the light emitting surface does not coincide with the lens focus, so that the light shape is slightly blurred, and the light shape connection performance is improved; and preferably, the minimum distance from the low-beam primary optical element 1 and the high-beam primary optical element 2 to the focal point of the secondary optical element 3 is less than or equal to 2 mm.

Figure 8:
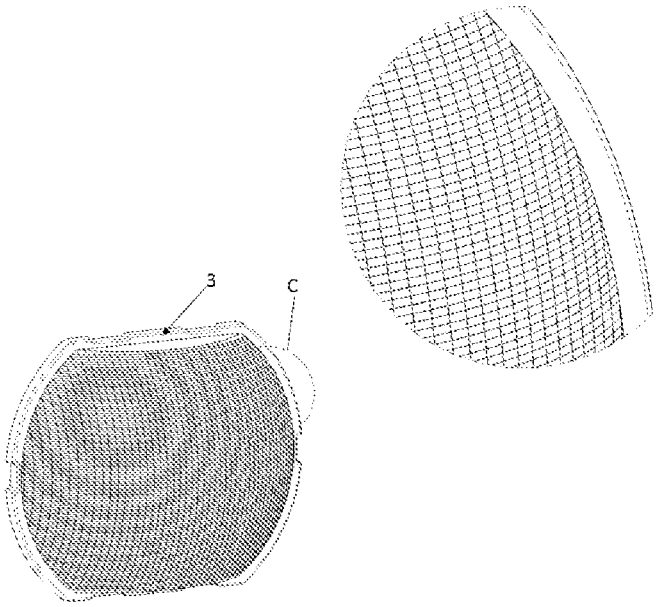
FIG. 8 is a structural schematic diagram of a grid structure on the secondary optical element according to an embodiment of the present disclosure and a partial enlarged view of a portion C.

In addition, referring to FIG. 8, a grid structure may be arranged or integrally formed on the light emitting surface of the secondary optical element 3 to facilitate dimming. The light emitting surface of the secondary optical element 3 is treated by adopting the grid-like structure, the size of grids is about 2*1 mm, the diffusion direction of light can be controlled by adjusting the size of the grids, generally, the larger the area of a single grid is, the more obvious the diffusion of light is, the proper area of the grids can be selected for treatment according to actual needs, the uniformity of the emitted light shapes is improved, and dispersion is weakened. Moreover, the primary optical elements are combined with the secondary optical element 3 of which the light emitting surface is treated by adopting the grid-like structure, more emitted light is refracted to the secondary optical element 3, the light energy utilization rate is high, and the emitted light passes through the light emitting surfaces of the primary optical elements and the grids of the light emitting surface of the secondary optical element 3 in sequence, uniformity of the emitted light shapes is better improved, and dispersion is weakened.

A single grid unit in the grid-like structure is a convex curved surface, a concave curved surface or a plane; further, when a single grid unit in the grid-like structure is a plane, the grid unit may be rectangular, square, triangular, polygonal, or in other irregular contour shapes. The grid-like structure may be a grid-like structure divided by transverse and longitudinal intersection and may also be a grid-like structure divided by oblique intersection, but the grid-like structure is not limited to the two grid-like structures and may be determined according to actual light shape requirements. Obviously, the grid-like structure can enlarge the illumination angle and improve the uniformity of light shapes.

Figure 3:
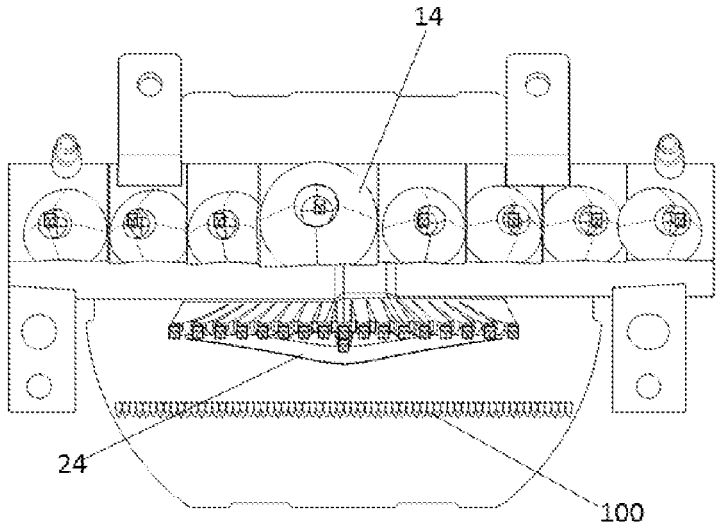
FIG. 3 is a schematic rear view of the vehicle lamp illumination module according to the first embodiment of the present disclosure.
Figure 4:
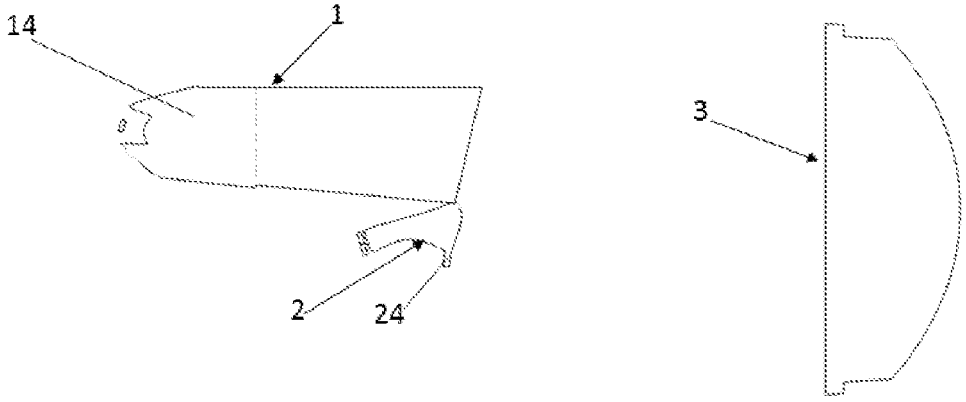
FIG. 4 is a schematic cross-sectional view of an optical element of the vehicle lamp illumination module according to the first embodiment of the present disclosure.
Figure 5:
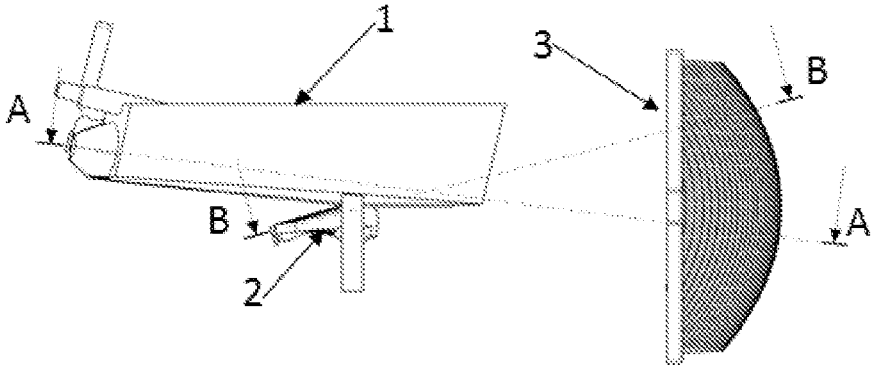
FIG. 5 is a schematic side view of the vehicle lamp illumination module according to the first embodiment of the present disclosure.
Figure 6:
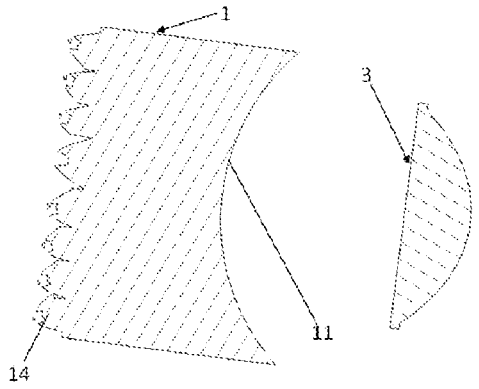
FIG. 6 is a cross-sectional view taken along line A-A of FIG. 5.
Figure 7:
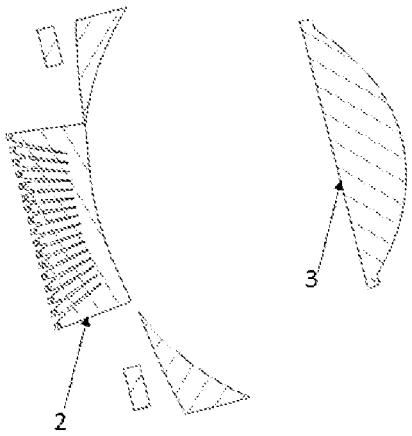
FIG. 7 is a cross-sectional view taken along line B-B of FIG. 5.
Figure 9:
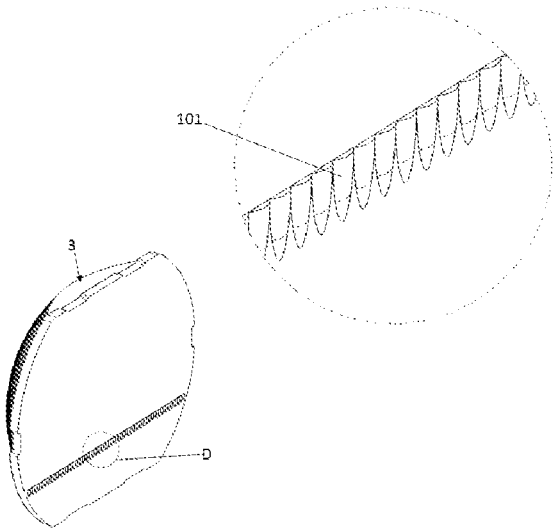
FIG. 9 is a structural schematic diagram of the low-beam region III forming structure on the secondary optical element according to an embodiment of the present disclosure and a partial enlarged view of a portion D.

According to an existing high-beam and low-beam integrated module, a low-beam region III forming structure 100 is usually arranged below a low-beam primary optical element 1, and due to the fact that the front end of the low-beam primary optical element 1 and the front end of the high-beam primary optical element 2 are connected with each other up and down, light from the low-beam region III forming structure 100 cannot be emitted to the secondary optical element 3 and projected to a low-beam region III light shape region; and for the technical defects, referring to FIG. 1, FIG. 3 and FIG. 9, the low-beam region III forming structure 100 is creatively arranged on the light incident surface of the secondary optical element 3, and the secondary optical element 3 is generally a lens.

Figure 40:
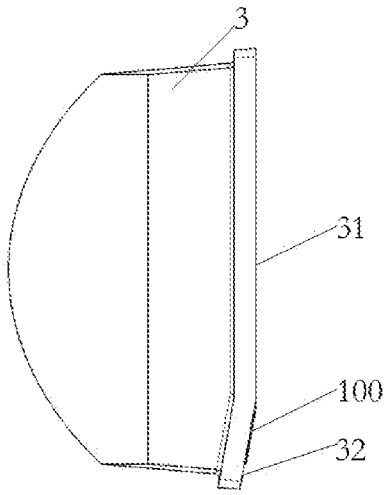
FIG. 40 is a first structural schematic diagram of the secondary optical element according to an embodiment of the present disclosure.
Figure 41:
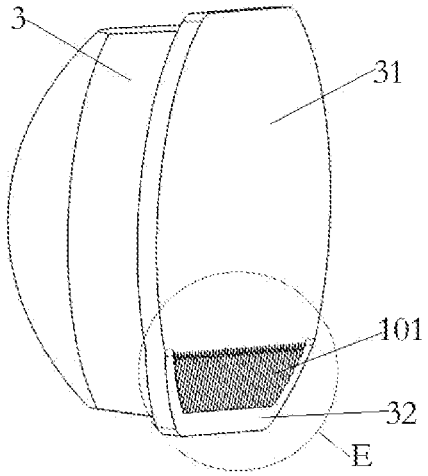
FIG. 41 is a second structural schematic diagram of the secondary optical element according to an embodiment of the present disclosure.
Figure 45:
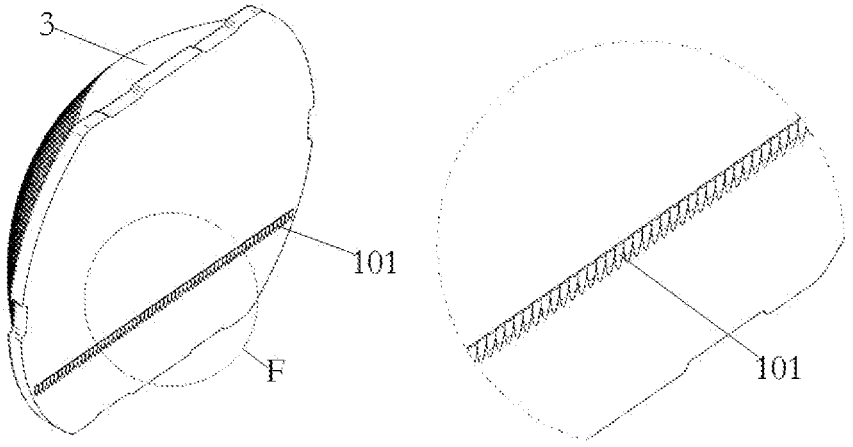
FIG. 45 is a fifth structural schematic diagram of the secondary optical element according to an embodiment of the present disclosure and a partial enlarged view of a portion F.
Figure 46:
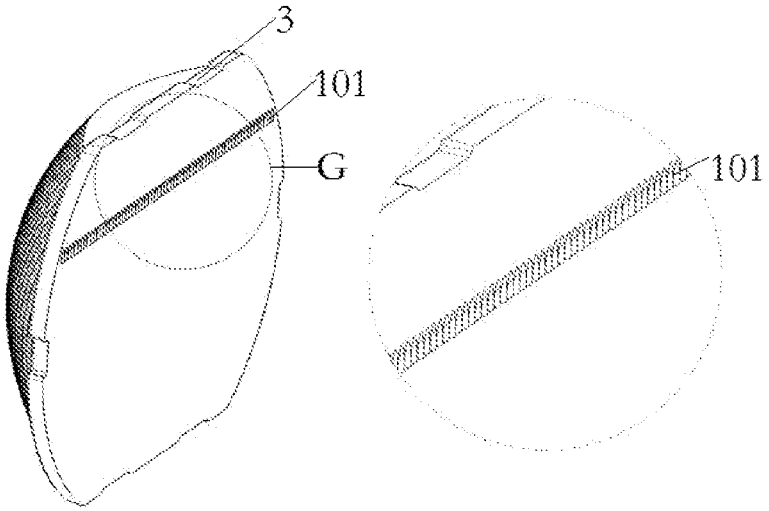
FIG. 46 is a sixth structural schematic diagram of the secondary optical element according to an embodiment of the present disclosure and a partial enlarged view of a portion G.
Figure 47:
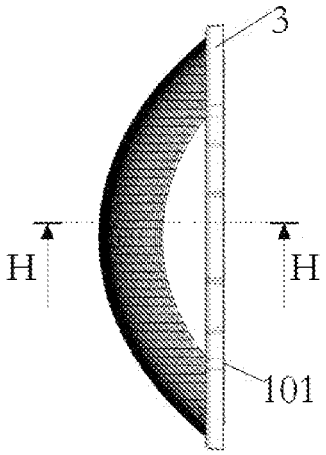
FIG. 47 is a seventh structural schematic diagram of the secondary optical element according to an embodiment of the present disclosure.

Referring to FIG. 40 and FIG. 41, a low-beam region III forming structure 100 is arranged or integrally formed on the secondary optical element 3 of the present disclosure, as shown in FIG. 45 and FIG. 46, the low-beam region III forming structure 100 may be located at any position of the light incident surface of the secondary optical element 3, the low-beam region III forming structure 100 includes multiple protrusions for diffusing light and protruding out of the light incident surface of the secondary optical element 3, is mainly used for forming a low-beam region III light shape, the low-beam region III light shape is continuous and uniform, and the illuminance of the low-beam region III light shape meets the requirements of regulations.

Further, as shown in FIG. 40, an upper portion and middle portion region 31 of the light incident surface of the secondary optical element 3 is a plane in the up-down direction, a lower portion region 32 of the light incident surface of the secondary optical element 3 is a plane inclined towards the light emitting direction from top to bottom, and the low-beam region III forming structure 100 is arranged or integrally formed on the lower portion region 32 of the light incident surface, and the low-beam region III forming structure 100 includes multiple protrusions which are used for diffusing light and protruding out of the lower portion region 32 of the light incident surface. The multiple protrusions of the lower portion region 32 of the light incident surface are used for diffusing light so as to ensure that the region III light shape of the low-beam shape is continuous and uniform and the illuminance of the region III light shape meets the requirements of regulations.

The upper portion and middle portion region 31 of the light incident surface of the secondary optical element 3 is a plane arranged in the up-down direction, and the lower portion region 32 of the light incident surface is inclined towards the light emitting direction from top to bottom, so that the light entering the lower-beam region III forming structure 100 can be refracted to the region III of the low-beam shape by the light emitting surface of the secondary optical element 3, namely, the light is refracted to a position above a cut-off line. Meanwhile, the low-beam region III forming structure 100 is arranged in the lower portion region 32 of the light incident surface of the secondary optical element 3, so that light is emitted into the secondary optical element 3 through the low-beam region III forming structure 100 and then is refracted out through the light emitting surface of the secondary optical element 3 to form a region III light shape portion of the low-beam shape.

Figure 42:
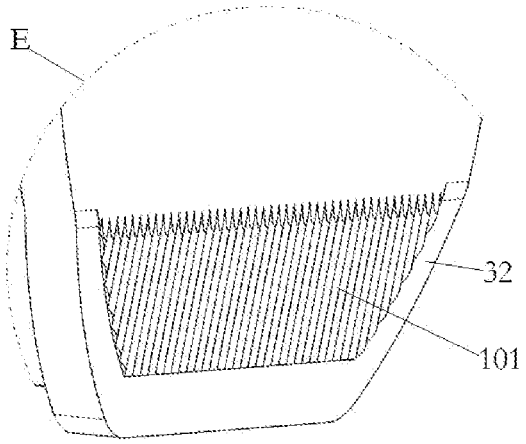
FIG. 42 is a partial enlarged view of a portion E in FIG. 41.

As shown in FIG. 42, as a specific implementation structure of the present disclosure, the low-beam region III forming structure 100 includes multiple longitudinal strip-shaped protrusions 101 extending in the up-down direction of the secondary optical element 3.

More specifically, the outer edge of the cross section of each longitudinal strip-shaped protrusion 100 is a convex curve of which the central region is higher than the two side regions.

Further specifically, the widths of the longitudinal strip-shaped protrusions 101 are equal.

Further, the central region of the curve of the outer edge of the cross section of each longitudinal strip-shaped protrusion 101 is higher than the two side regions, and the widths of the longitudinal strip-shaped protrusions 100 are equal, so that the longitudinal strip-shaped protrusions 101 are convenient for diffusing light in the left-right direction.

Figure 43:
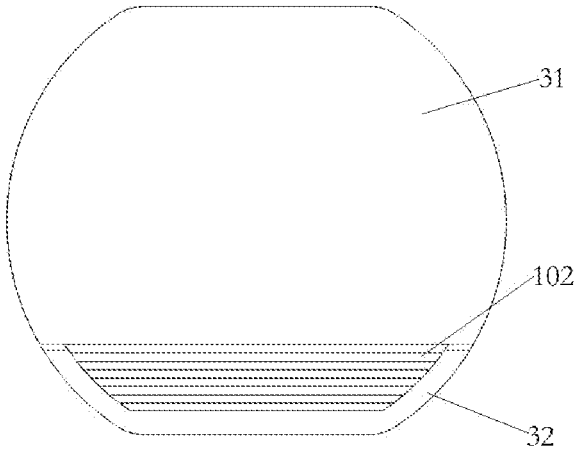
FIG. 43 is a third structural schematic diagram of the secondary optical element according to an embodiment of the present disclosure.

As shown in FIG. 43, as an alternative to a specific implementation structure of the present disclosure, the low-beam region III forming structure 100 includes multiple transverse strip-shaped protrusions 102 extending in the left-right direction of the secondary optical element 3.

More specifically, the outer edge of the longitudinal section of each transverse strip-shaped protrusion 102 is a convex curve of which the central region is higher than the two side regions.

Further specifically, the widths of the transverse strip-shaped protrusions 102 are equal.

Further, the central region of the curve of the outer edge of the longitudinal section of each transverse strip-shaped protrusion 102 is higher than the two side regions, and the widths of the transverse strip-shaped protrusions 102 are equal, so that the transverse strip-shaped protrusions 102 are convenient for diffusing light in the up-down direction.

Figure 44:
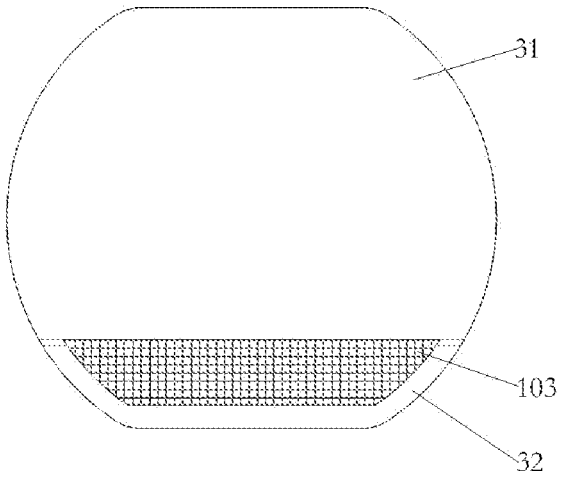
FIG. 44 is a fourth structural schematic diagram of the secondary optical element according to an embodiment of the present disclosure.

As shown in FIG. 44, as a further alternative to a specific implementation structure of the present disclosure, the low-beam region III forming structure 100 includes multiple block-shaped protrusions 103 formed by connecting convex curved surfaces.

As a specific structural form of an optional specific implementation structure, the central region of each block-shaped protrusion 103 is higher than the peripheral region, and the block-shaped protrusions 103 facilitate diffusion of light to the periphery.

The protrusions of the low-beam region III forming structure 100 in the three specific embodiments are the longitudinal strip-shaped protrusions 101, the transverse strip-shaped protrusions 102 and the block-shaped protrusions 103 respectively, and the longitudinal strip-shaped protrusions 101 can enable light passing through the longitudinal strip-shaped protrusions 101 to be diffused towards the left-right direction; the transverse strip-shaped protrusions 102 can enable light passing through the transverse strip-shaped protrusions 102 to be diffused towards the up-down direction; and the block-shaped protrusions 103 can enable light passing through the block-shaped protrusions 103 to be diffused towards the periphery. However, the protrusions of the low-beam region III forming structure 100 are not limited to the three forms, but can also in other shapes, and the specific shape needs to be changed according to the needs of the light shapes.

As another specific implementation structure of the present disclosure, as shown in FIG. 45 to FIG. 48, the low-beam region III forming structure 100 includes multiple longitudinal strip-shaped protrusions 101 which are sequentially arranged from the left side edge to the right side edge of the light incident surface, the longitudinal strip-shaped protrusions 101 are connected to form a strip-shaped structure, and the longitudinal cutting lines of the light incident surfaces of the longitudinal strip-shaped protrusions 101 are inclined towards the light emitting direction from top to bottom.

Figure 49:
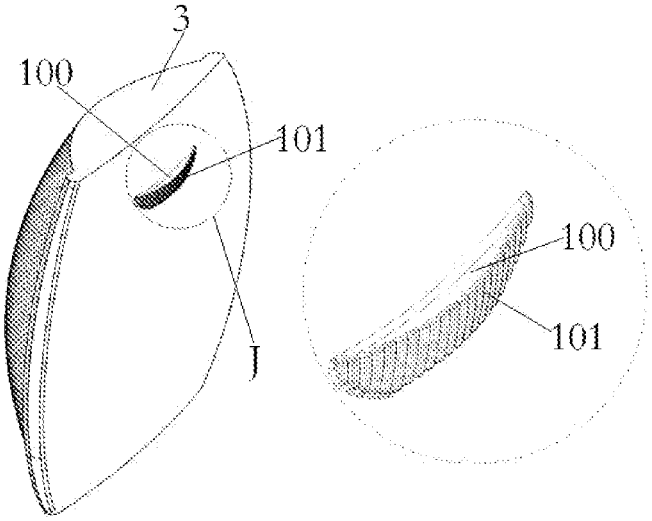
FIG. 49 is an eighth structural schematic diagram of the secondary optical element according to an embodiment of the present disclosure and a partial enlarged view of a portion J.

Optionally, as shown in FIG. 49, the low-beam region III forming structure 100 includes a section of protrusion structure formed by connecting the multiple longitudinal strip-shaped protrusions 101 and arranged on the light incident surface, the width of the transverse section of the protrusion structure is gradually reduced from the middle to the two sides, and the longitudinal cutting lines of the light incident surfaces of the longitudinal strip-shaped protrusions 101 are inclined towards the light emitting direction from top to bottom.

Figure 48:
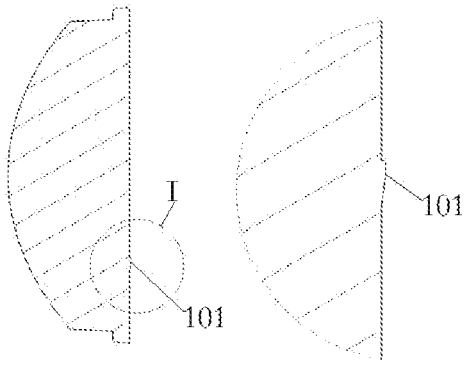
FIG. 48 is a cross-sectional view taken along line H-H in FIG. 47 and a partial enlarged view of a portion I.
Figure 50:
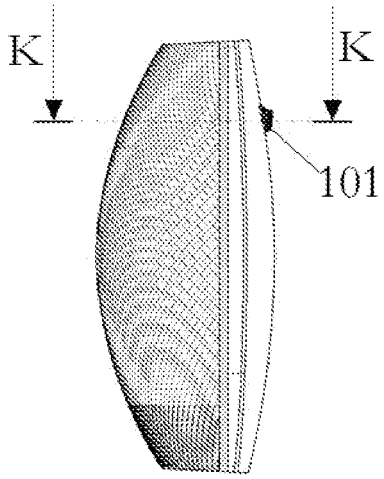
FIG. 50 is a ninth structural schematic diagram of the secondary optical element according to an embodiment of the present disclosure.
Figure 52:
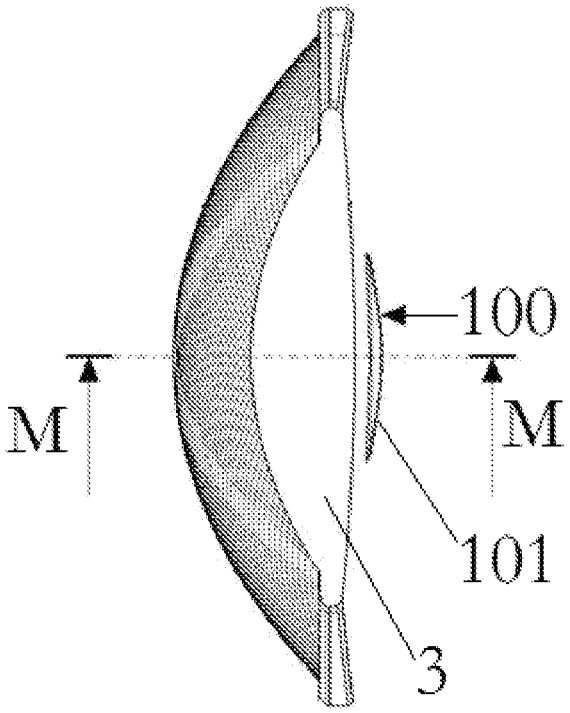
FIG. 52 is a tenth structural schematic diagram of the secondary optical element according to an embodiment of the present disclosure.
Figure 53:
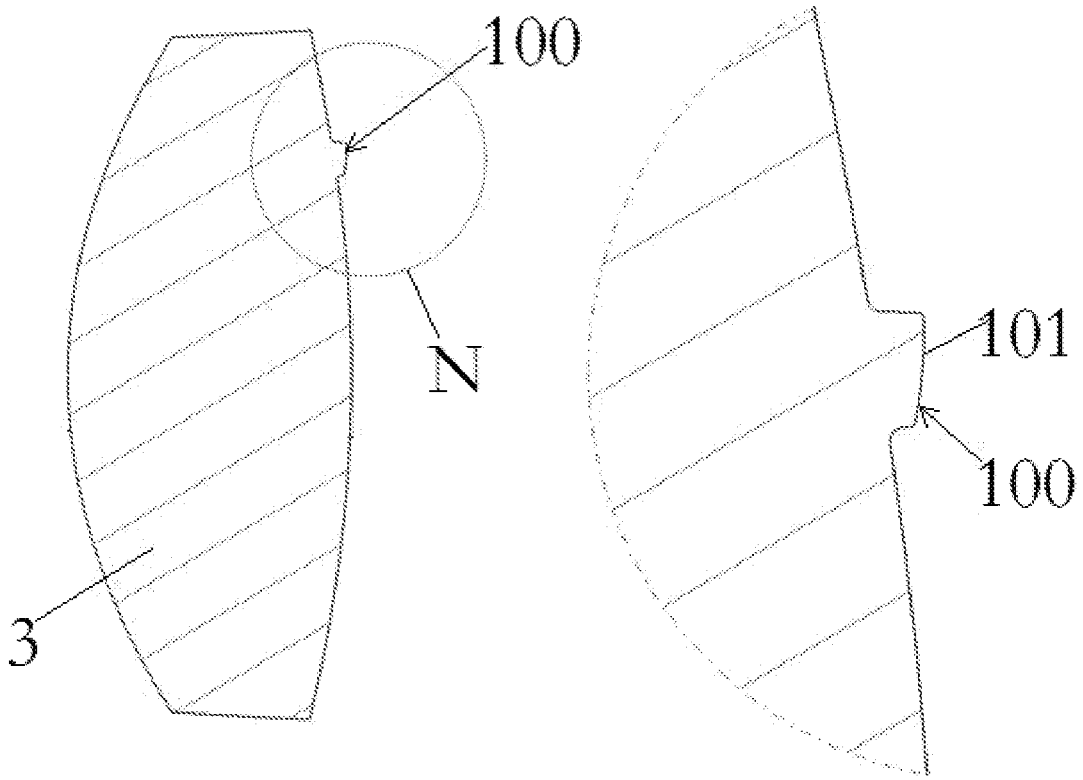
FIG. 53 is a cross-sectional view taken along line M-M in FIG. 52 and a partial enlarged view of a portion N.

The low-beam region III forming structure 100 shown in FIG. 41 to FIG. 44 is a protrusion structure overlying the lower portion region 12 of the light incident surface of the secondary optical element 3; as can be seen from FIG. 45 and FIG. 48, the low-beam region III forming structure 100 may also be the multiple longitudinal strip-shaped protrusions 101 sequentially arranged from the left side edge to the right side edge of the light incident surface, the longitudinal strip-shaped protrusions 101 are connected to form a strip-shaped structure, and in order to meet the light distribution requirement of the low-beam region III light shape, as shown in FIG. 48, the longitudinal section line of the light incident surface of the longitudinal strip-shaped protrusion 13*a* is inclined towards the light emitting direction from top to bottom; as can be seen from FIG. 49 and FIG. 52, the low-beam region III forming structure 100 may also be a section of protrusion structure formed by connecting the multiple longitudinal strip-shaped protrusions 101 and arranged on the light incident surface, and the position and the form of the section of protrusion structure may be designed according to the actual forming requirement of the low-beam region III light shape, for example, the section of protrusion structure shown in FIG. 49 is located in the middle of the upper portion of the light incident surface, the lengths of the longitudinal strip-shaped protrusions 101 are gradually reduced from the middle to the two sides, and similarly, as shown in FIG. 50, the longitudinal section lines of the light incident surfaces of the longitudinal strip-shaped protrusions 101 are inclined towards the light emitting direction from top to bottom so as to meet the light distribution requirement of the low-beam region III light shape. Of course, the protrusions in FIG. 45, FIG. 46 and FIG. 49 may also take the form of transverse strip-shaped protrusions 13*b* or block-shaped protrusions 13*c*, or other structural forms.

As shown in FIG. 45, the low-beam region III forming structure 100 is formed on the lower portion of the light incident surface, wherein the light incident surface is a plane in the up-down direction; as shown in FIG. 46, the low-beam region III forming structure 100 is formed on the upper portion of the light incident surface, the light incident surface is also a plane in the up-down direction, and the position change of the low-beam region III forming structure 100 on the light incident surface does not affect formation of the low-beam region III light shape, so that the low-beam region III forming structure 100 can be arranged at any position of the light incident surface according to actual needs, as long as the low-beam region III forming structure 100 in various structural forms meeting the light distribution requirements of the low-beam region III is adopted, light can be emitted into the secondary optical element 3 through the low-beam region III forming structure 100 and then is refracted out through the light emitting surface of the secondary optical element 3, and the region III light shape portion of the low-beam shape is formed.

Figure 51:
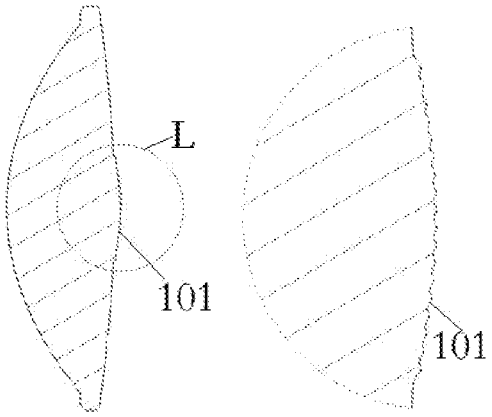
FIG. 51 is a cross-sectional view taken along line K-K in FIG. 50 and a partial enlarged view of a portion L.

As another specific structural form of the present disclosure, as shown in FIG. 50 and FIG. 51, the light emitting surface of the secondary optical element 3 is a convex curved surface.

As another specific embodiment of the present disclosure, as shown in FIG. 50 and FIG. 51, the light incident surface of the secondary optical element 3 is a plane or a convex curved surface.

If the light emitting surface and the light incident surface of the secondary optical element 3 are both convex curved surfaces, the secondary optical element 3 of the present disclosure is a biconvex lens; and if the light emitting surface is a convex curved surface and the light incident surface is a plane, the secondary optical element 3 of the present disclosure is a planoconvex lens. It should be noted here that whether the secondary optical element 3 of the present disclosure is a planoconvex lens or a biconvex lens does not have necessary correspondence to the specific low-beam region III forming structure 100, namely, a planoconvex lens and a biconvex lens may be used in combination with any low-beam region III forming structure 100.

The disclosure further provides a vehicle lamp, in which a light propagation path is formed, the vehicle lamp includes a vehicle lamp illumination module, a radiator 6 and a lens mounting support 7, the vehicle lamp illumination module is any one of the vehicle lamp illumination modules in the technical solution, wherein the secondary optical element 3 is a lens, and is connected with the radiator 6 through the lens mounting support 7, and the vehicle lamp illumination module is mounted on the radiator 6 and located in a cavity defined by the radiator 6 and the lens mounting support 7.

Figure 25:
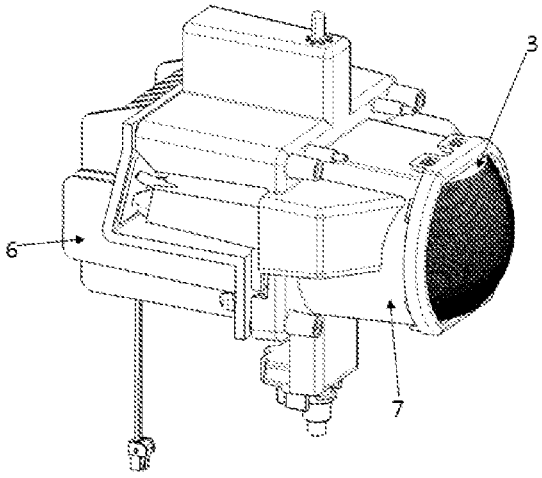
FIG. 25 is a structural schematic diagram of a vehicle lamp according to an embodiment of the present disclosure.
Figure 26:
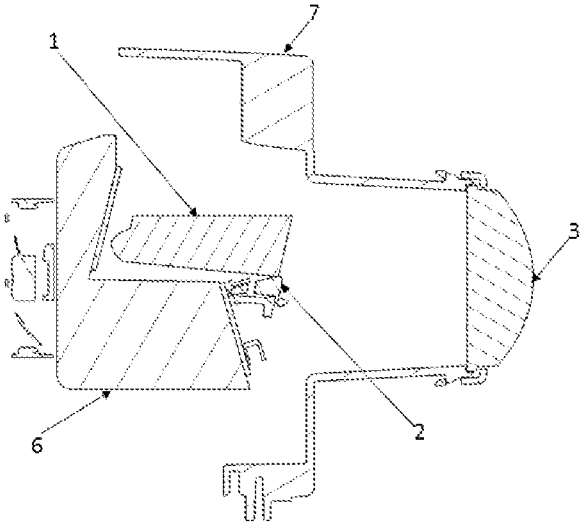
FIG. 26 is a longitudinal section view of the vehicle lamp according to an embodiment of the present disclosure.

As shown in FIG. 25 and FIG. 26, the light sources may be LED chips, and the LED light sources which are used as new energy sources gradually replace traditional light sources, and the LED light sources are energy-saving and environment-friendly, long in service life, high in brightness, stable in performance and high in luminous purity. An LED chip is installed on a circuit board, connecting structures such as positioning holes, threaded holes and positioning pins may be arranged on the low-beam primary optical element 1 and the high-beam primary optical element 2, and correspondingly, the positioning pins, the threaded holes and the positioning holes may also be arranged on the circuit board and the radiator 6, and the low-beam primary optical element 1, the high-beam primary optical element 2, the circuit board and the radiator 6 are sequentially positioned and connected through positioning pins, bolts and the like;

the low-beam primary optical element 1 and the high-beam primary optical element 2 are generally transparent optical elements made of transparent materials such as glass, silica gel or plastic, and the primary optical elements such as the low-beam primary optical element 1 and the high-beam primary optical element 2 can perform primary light distribution (such as focusing and collimation) on light emitted from the light sources, so that the primary optical elements play a great role in the vehicle lamp illumination effect, and the positioning and mounting reliability of the primary optical elements greatly affects the precision of the light shapes of the vehicle lamp and the vehicle lamp illumination effect; meanwhile, any component arranged on the primary optical elements may influence primary distribution of light, and excessive mounting structures and positioning structures may generate more or less influence on the light distribution effect of the primary optical elements. Therefore, the low-beam primary optical element 1 and the high-beam primary optical element 2 may be sequentially positioned and connected with the circuit board and the radiator 6 through the limiting structure related to the technical solution of the vehicle lamp illumination module of the present disclosure, and a better illumination effect is achieved.

It should be noted that the light sources of the present disclosure may be LED light sources and are not limited to LED light sources, and laser light sources or other similar light sources are used, and all belong to the scope of protection of the prevent disclosure. The multiple light sources are arranged in a dispersed manner, so that the heat sources can be dispersed, and the heat dissipation performance is improved.

Figure 54:
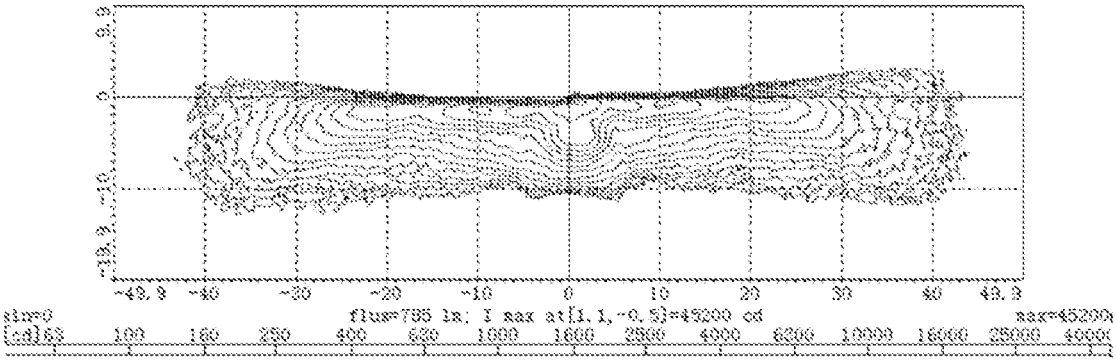
FIG. 54 is a light shape graph when the low-beam region III forming structure is not arranged.
Figure 55:
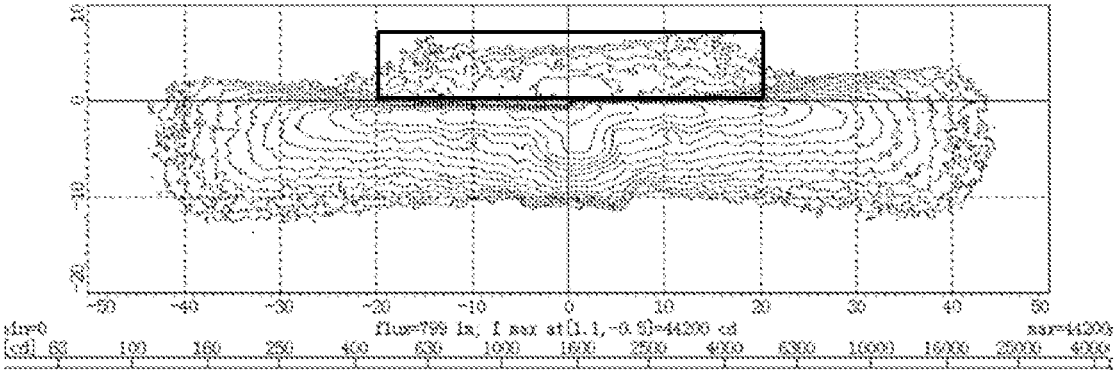
FIG. 55 is a light shape graph when the low-beam region III forming structure is arranged according to an embodiment of the present disclosure.

FIG. 54 is a light shape graph when the low-beam region III forming structure 100 is not arranged, and FIG. 55 is a light shape graph when the low-beam region III forming structure 100 is arranged. In the light shape graph shown in FIG. 55, light emitted by the light sources is converged and collimated by the low-beam primary optical element 1, is emitted into the secondary optical element 3 provided with the low-beam region III forming structure 100 of the present disclosure, and then is refracted by a light emitting surface of the secondary optical element 3 to form a low-beam region III light shape. The light shape is formed by projecting light from the vehicle lamp illumination module onto a light distribution screen, and the light distribution screen is a vertical screen which is arranged at the position 25 m in front of a vehicle. The portion of the light shape framed in the box in FIG. 55 is the low-beam region III light shape located above the cut-off line. The low-beam region III forming structure 100 is arranged on the light incident surface of the secondary optical element 3, the structure is more compact, interference between the low-beam region III forming structure 100 and other parts is not likely to occur, and the manufacturing cost is not increased.

The disclosure further provides a vehicle. The vehicle includes the vehicle lamp in any one of the technical solutions.

As can be seen from the description above, the low-beam region III forming structure 100 is ingeniously arranged on the secondary optical element 3, and under the condition that the lower boundary of the front end of the low-beam primary optical element 1 is connected with the upper boundary of the front end of the high-beam primary optical element 2, light can be smoothly projected to the low-beam region III light shape region to form the low-beam region III light shape, and the low-beam region III forming structure 100 is not prone to interfere with other parts, so that the optical performance is more stable; the lower boundary of the front end of the low-beam primary optical element 1 is connected with the upper boundary of the front end of the high-beam primary optical element 2, so that an air layer is formed between the low-beam primary optical element 1 and the high-beam primary optical element 2, and light is better totally reflected in a light channel; due to adoption of the structural design of the low-beam primary optical element 1 and the high-beam primary optical element 2 is adopted, parts such as a light shielding plate and an electromagnetic valve are not needed, the occupied space is small, miniaturization of the vehicle lamp illumination module and the vehicle lamp is facilitated, the structure is relatively simplified, and the structural design of the vehicle is facilitated; moreover, both the low-beam primary optical element 1 and the high-beam primary optical element 2 can be composed of collimation units 21 to form a multi-channel light condensing element, so that accurate control over light shapes is facilitated, the illumination effect is improved, light emitted by the light sources cannot be mixed to a certain degree and can form respective independent light shapes, and when one light source is turned off, a clear light shape shielding region can be formed so as to fulfill a low-beam follow-up steering function or a high-beam dazzling prevention function; and the low-beam region III forming structure 100 has various structural forms, is simple in structure, is processed conveniently, and can meet different design requirements.

Preferred embodiments of the present disclosure have been described in detail above in connection with the accompanying drawings, however, the present disclosure is not limited thereto. Within the scope of the technical conception of the present disclosure, a number of simple modifications can be made to the technical solutions of the present disclosure, including the combination of the various specific technical features in any suitable manner. In order to avoid unnecessary repetition, the various possible combinations of the present disclosure are not otherwise described. Such simple modifications and combinations should also be considered as disclosed in the present disclosure, and all such modifications and combinations are intended to be included within the scope of protection of the present disclosure.

The invention claimed is:

1. A vehicle lamp illumination module, comprising light sources, a low-beam primary optical element, a high-beam primary optical element and a secondary optical element, wherein:

the low-beam primary optical element is configured to guide light to be sequentially emitted via the low-beam primary optical element and the secondary optical element to form a low-beam shape, and the high-beam primary optical element comprises multiple collimation units, wherein surfaces of light emitting ends of the collimation units are connected to each other or integrally formed to form a high-beam light emitting surface, and light incident ends of the collimation units have one-to-one correspondence to the light sources, so that the light can be sequentially emitted via the high-beam primary optical element and the secondary optical element to form a high-beam shape;

the low-beam primary optical element comprises a low-beam light incident surface, a low-beam light guide portion and a low-beam light emitting surface, wherein the low-beam light guide portion is configured to guide light received by the low-beam light incident surface to be emitted to the low-beam light emitting surface, a reflection portion is formed on the lower surface of the low-beam light guide portion, multiple light condensing structures which are sequentially arranged and have one-to-one correspondence to the light sources are mounted on the low-beam light incident surface, and a low-beam cut-off portion used for forming a low-beam shape cut-off line is formed on the low-beam primary optical element; and the lower edge of the low-beam light emitting surface of the low-beam primary optical element is connected with the upper edge of the high-beam light emitting surface of the high-beam primary optical element, and a wedge-shaped gap which is gradually increased from front to rear is formed between the low-beam primary optical element and the high-beam primary optical element;

wherein a low-beam region III forming structure used for forming a region III light shape is arranged on a light incident surface of the secondary optical element;

the low-beam region III forming structure comprises multiple longitudinal strip-shaped protrusions extending in the up-down direction of the secondary optical element, a longitudinal cutting line of the light incident surface of each longitudinal strip-shaped protrusion is inclined from top to bottom towards the light emitting direction.

2. The vehicle lamp illumination module according to claim 1, wherein an outer edge of the cross section of each longitudinal strip-shaped protrusion is a convex curve of which a central region is higher than two side regions.

3. The vehicle lamp illumination module according to claim 1, wherein widths of the longitudinal strip-shaped protrusions are the same.

4. The vehicle lamp illumination module according to claim 1, wherein the light incident surface of the secondary optical element is a plane or a convex curved surface.

5. The vehicle lamp illumination module according to claim 1, wherein an upper portion and middle portion region of the light incident surface of the secondary optical element is a plane in the up-down direction, a lower portion region of the light incident surface of the secondary optical element is a plane which is inclined towards the light emitting direction from top to bottom, and the low-beam region III forming structure is located on the lower portion region.

6. A vehicle lamp illumination module, comprising light sources, a low-beam primary optical element, a high-beam primary optical element and a secondary optical element, wherein:

the low-beam primary optical element is configured to guide light to be sequentially emitted via the low-beam primary optical element and the secondary optical element to form a low-beam shape, the high-beam primary optical element comprises multiple collimation units, the surfaces of light emitting ends of the collimation units are connected to each other or integrally formed to form a high-beam light emitting surface, and light incident ends of the collimation units have one-to-one correspondence to the light sources, so that the light can be sequentially emitted via the high-beam primary optical element and the secondary optical element to form a high-beam shape;

the low-beam primary optical element comprises a low-beam light incident surface, a low-beam light guide portion and a low-beam light emitting surface, the low-beam light guide portion is configured to guide light received by the low-beam light incident surface to be emitted to the low-beam light emitting surface, a reflection portion is formed on the lower surface of the low-beam light guide portion, multiple light condensing structures which are sequentially arranged and have one-to-one correspondence to the light sources are mounted on the low-beam light incident surface, and a low-beam cut-off portion used for forming a low-beam shape cut-off line is formed on the low-beam primary optical element;

the lower edge of the low-beam light emitting surface of the low-beam primary optical element is connected with the upper edge of the high-beam light emitting surface of the high-beam primary optical element, and a wedge-shaped gap which is gradually increased from front to rear is formed between the low-beam primary optical element and the high-beam primary optical element;

wherein a low-beam region III forming structure used for forming a region III light shape is arranged on a light incident surface of the secondary optical element;

the low-beam region III forming structure comprises multiple block-shaped protrusions which are formed by connecting convex curved surfaces.

7. The vehicle lamp illumination module according to claim 6, wherein a central region of each block-shaped protrusion is higher than a peripheral region.

8. The vehicle lamp illumination module according to claim 6, wherein the light incident surface of the secondary optical element is a plane or a convex curved surface.

9. The vehicle lamp illumination module according to claim 6, wherein an upper portion and middle portion region of the light incident surface of the secondary optical element is a plane in the up-down direction, a lower portion region of the light incident surface of the secondary optical element is a plane which is inclined towards the light emitting direction from top to bottom, and the low-beam region III forming structure is located on the lower portion region.

* * * * *